US007740219B2

(12) United States Patent
Stengel et al.

(10) Patent No.: US 7,740,219 B2
(45) Date of Patent: Jun. 22, 2010

(54) EASEL FOR SUPPORTING A FLIP CHART OR OTHER DISPLAY DEVICE WITH COLLAPSIBLE FOLDABLE LEGS

(75) Inventors: Michael John Stengel, Town and City, MO (US); Trung Q. Do, Bridgeton, MO (US)

(73) Assignee: Swank Audio Visuals, LLC, St. Louis, MO (US)

( * ) Notice: Subject to any disclaimer, the term of this patent is extended or adjusted under 35 U.S.C. 154(b) by 0 days.

(21) Appl. No.: 11/948,855

(22) Filed: Nov. 30, 2007

(65) Prior Publication Data

US 2008/0173782 A1 Jul. 24, 2008

Related U.S. Application Data

(60) Provisional application No. 60/867,954, filed on Nov. 30, 2006.

(51) Int. Cl.
*A47B 97/04* (2006.01)

(52) U.S. Cl. ..... 248/464; 40/607.04; 248/166; 248/173

(58) Field of Classification Search ..... 248/450, 248/460, 463, 464, 465, 150, 166, 439, 167, 248/173, 440, 170; 40/607.04; 403/220, 403/291

See application file for complete search history.

(56) References Cited

U.S. PATENT DOCUMENTS 4,171,116 A * 10/1979 Carver et al. ..... 248/464
4,609,174 A * 9/1986 Nakatani ..... 248/465
4,611,946 A * 9/1986 Gebelius ..... 403/102
5,125,613 A * 6/1992 Albee et al. ..... 248/464
5,518,217 A 5/1996 Deutsch et al.
5,683,199 A * 11/1997 Tehan ..... 403/314
5,713,552 A * 2/1998 Diamant ..... 248/460
6,179,266 B1 * 1/2001 Hutten ..... 248/465
6,601,805 B1 * 8/2003 Kapp ..... 248/171
6,666,424 B2 * 12/2003 Richardson ..... 248/460
6,889,952 B2 5/2005 Cook et al.
2003/0193004 A1 * 10/2003 Kapp ..... 248/460
2007/0135618 A1 * 6/2007 Peakman et al. ..... 530/324
2008/0116347 A1 * 5/2008 Stengel et al. ..... 248/460

* cited by examiner

*Primary Examiner*—Ramon O Ramirez
(74) *Attorney, Agent, or Firm*—Howard B. Rockman

(57) ABSTRACT

A collapsible easel with foldable legs adapted to support a display device comprising a combination display panel and folded legs. In one embodiment, a three-leg assembly is pivotally connected to the display panel. The portions of each leg are connected by a linearly flexible strap. The linearly flexible strap allows the upper and lower portion of each leg to be pulled in opposite directions relative to each upper and lower portion of each leg, enabling one portion of each leg to be folded over the other portion. In another embodiment of the easel, a channel is connected to each of at least three legs and the channels allow the legs to be individually nested in contact with the rear side of the display panel. Each front leg is connected to the rear leg by a hinge assembly that comprises two struts pivotally connected near a center of the hinge assembly.

23 Claims, 20 Drawing Sheets

FIG. 23
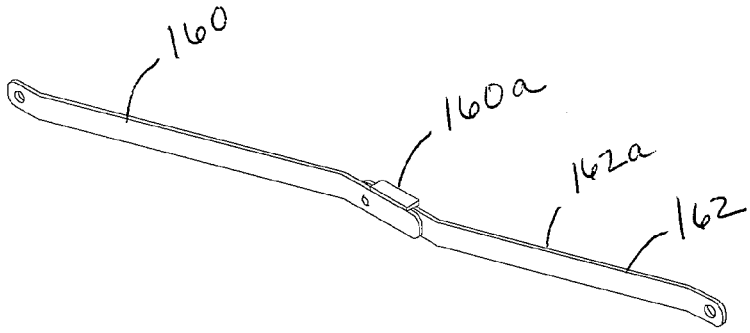
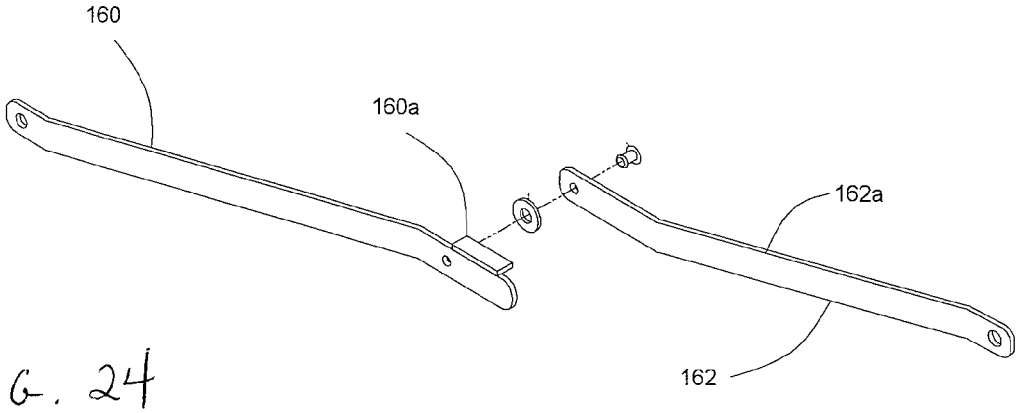
FIG. 24

EASEL FOR SUPPORTING A FLIP CHART OR OTHER DISPLAY DEVICE WITH COLLAPSIBLE FOLDABLE LEGS

CROSS REFERENCE TO RELATED APPLICATIONS

This application claims priority from provisional application No. 60/867,954 filed on Nov. 30, 2006 to the extent allowed by law.

FIELD OF THE INVENTION

The invention relates to a display module and more particularly to a display easel for a flip chart or other visual aid, the easel having a collapsible leg assembly with foldable legs for easier transportation and storage.

BACKGROUND OF THE INVENTION

The presentation of graphics, charts, and written materials for teaching and for business conferences and other meetings has evolved significantly over the years. The present invention relates generally to portable display modules, and more particularly to a display easel for a flip chart or other visual aid having a collapsible leg assembly with foldable legs for easier transportation and storage.

The traditional artist's easel often takes the form of a tripod-like frame adapted to hold a canvas at a proper angle for an artist's convenience. Over the years, the easel has evolved into an all-purpose support with various leg assemblies for various types of removable and replaceable displays.

Flip chart presentations, for example, are frequently made in boardrooms, conference rooms, and other meeting places. As a result, an easel designed to hold flip charts or other visual aids must be easily portable, and storable between various locations and various uses. Furthermore, the typical easel is not well suited for easy, compact transport and storage.

From a user's perspective, the ease of assembly, use, and operation, as well as the ability to transport and store the easel are important points of consideration. It is preferable to have an easel wherein the legs are individually foldable to reduce the easel to a compact size for transportation and storage. It is also preferable to have an easel that may be removably connected to other equipment to further facilitate efficient transportation and/or storage. Additionally, it is preferable that the entire easel does not occupy an inordinate amount of space while being stored.

For the foregoing reasons, there is a need for an easy to use collapsible easel with individual foldable legs.

Various designs for easels and presentation devices are disclosed in the prior art. U.S. Pat. No. 5,518,217 entitled "Stackable Presentation Board With Collapsible Legs and Pad Holder" discloses a presentation board with legs collapsible into a rear surface of the body of the presentation board. U.S. Pat. No. 6,889,952 entitled "Multi-Position Presentation Easel" discloses a portable easel having a frame and a display panel movably coupled to the frame. U.S. Pat. No. 6,179,266 entitled "Collapsible Easel" discloses a collapsible easel having three elongated telescoping legs. None of the disclosures in these patents teach or suggest a portable easel having individual collapsible, foldable legs or an apparatus for connecting the easel to other equipment during transport and storage.

SUMMARY OF THE INVENTION

The invention is directed to an easel having foldable legs for easy storage and transportation as well as a display panel for flip charts or other visual presentation aids. One embodiment of the easel includes a three-leg support assembly and a front display panel member.

The leg assembly has two front legs and one rear leg. In an embodiment, the front legs have a curved portion and a straight portion. The rear leg is also comprised of two portions wherein both portions are straight. The rear leg has a longer length relative to the two front legs. In one embodiment, the portions of each leg are connected via a flexible strap connected to and extending from the first portion of the leg and connected to a second portion of the leg via an aperture formed on an end of the strap and held in place by a screw or similar fastener extending transversely through the leg structure and locked in place by a nut and washer or other similar assembly. Another screw assembly extends through the leg and through an aperture at the opposite end of the flexible strap to hold the two portions of the leg together via the strap. The portions of the legs are held together concentrically when in the locked position, the second portion extending a partial distance inside the first portion of each leg. The portions of each leg are adapted to be manually pulled in opposite directions relative to each other and to be held in connection via the flexible strap extended beyond the strap's resting position. When the flexible strap has been extended, the first and second portions of the legs may be folded or pivoted toward each other about the flexible strap to reduce the length of each leg and provide for easier transportation and storage of the easel. An additional clasp located on the display panel holds each folded leg in place along the display panel for storage and/or transportation.

When the legs are fully extended in their supporting position, the legs are held firmly in a tripod configuration by a spring locking assembly. In one embodiment, the spring locking assembly has a V-shaped design and pivotally connects to the rear leg of the easel via a bracket. The locking assembly includes a horizontal bar with two extensions connected to the horizontal bar and extending away from the horizontal bar at an angle to the plane of the bar. The spring locking assembly is pivotally mounted to the rear leg of the leg assembly via a bracket located on the horizontal bar and engages the front legs of the leg assembly via a spring latching mechanism when the extensions of the spring locking assembly are pressed inward and released. The front legs of the leg assembly receive the extensions in apertures located in each of the front legs.

The display panel is connected to the leg assembly via a bracket configuration at the upper end of the display panel. The bracket is bolted to the leg assembly through apertures in the two front legs. The display panel has a generally rectangular shape with a top edge, a bottom edge, a first side, a second side, a front side, and a rear side. An extension structure located near the bottom edge of the display frame holds a bracket for supporting writing instruments or other equipment. The top edge of the display frame further includes a connection for attachment of a flip chart or other visual display device to the display panel. The connection can be a spring, clip, or other equivalent structure. In an illustrated embodiment, the connection is a self-acting spring, hinged to the top edge of the display panel, the spring being pulled by a user in an upward direction opposite the plane of the display panel allowing the creation of space to slide or place a visual aid, such as a flip chart, near the top edge of the display frame. The self-acting spring returns to its resting position adjacent the display frame, holding the visual aid securely in place between the spring and the display panel.

In an illustrated embodiment, the display panel further includes at least one aperture located in the display panel through the front side and the rear side to provide for removable mounting to another apparatus if desired by a user during transportation or storage.

In another illustrated embodiment of the easel, the legs of the easel may be adapted to contain a material such as foam polyurethane or the like to minimize noise and vibration through the easel. The material may be heat activated such that the material will be installed during manufacture of the easel and expand when a coating is baked on the legs of the easel. The material may be located in the form of blocks throughout the legs of the easel.

In a second embodiment of the easel, a channel is connected to each of at least three legs and is adapted to allow the legs to be individually nested in contact with the rear side of the display panel. The at least three legs include two front legs and a rear leg. The channel for the rear leg is connected to a pivoting flange on the rear side of the display panel which pivots away from the display panel at an angle to allow the easel to be supported in an open tripod position. Each front leg is connected to the rear leg by a hinge assembly. Each hinge assembly comprises two struts pivotally connected near a center of the hinge assembly and is adapted to be rotated downward to support the easel in an open position and upward to collapse the easel to a folded position.

BRIEF DESCRIPTION OF THE DRAWINGS

FIG. 23 is a detail view of the hinge assembly connecting the legs of the embodiment of the easel shown in FIG. 18; and FIG. 24 is an exploded detail view of the hinge assembly connecting the legs of the embodiment of the easel shown in FIG. 18.

DETAILED DESCRIPTION OF THE ILLUSTRATED EMBODIMENT

The invention is generally directed to an easel having foldable legs for easy storage and transport as well as a display panel for mounting flip charts and other visual presentation aids. As shown in FIGS. 1-7, an embodiment of the easel 10 includes a front panel display member 12 and a three-leg assembly 14. When expanded laterally, the three-leg assembly 14 forms a tripod configuration to provide a sturdy support for display member 12.

Figure 4:
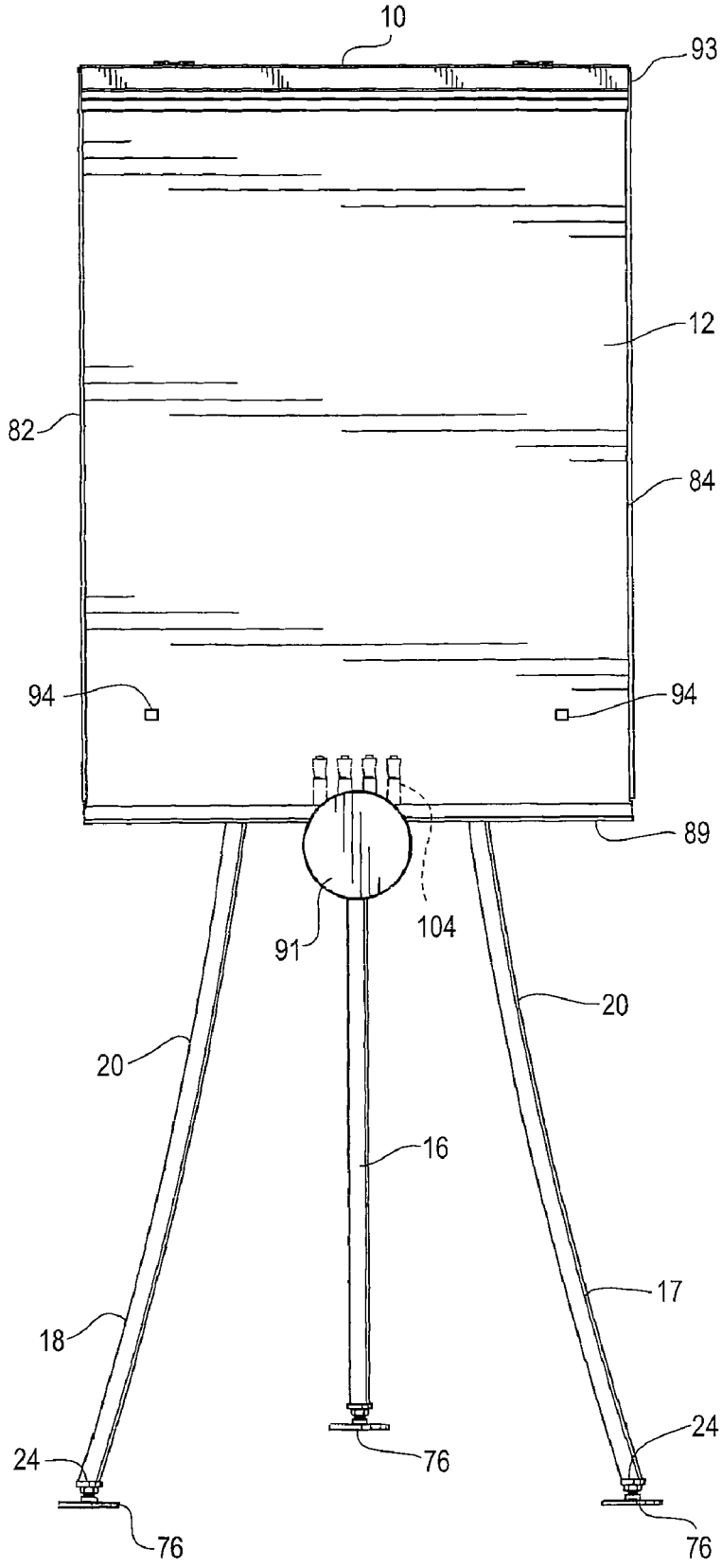
FIG. 4 is a front elevation view of the embodiment of the collapsible easel shown in FIG. 1.
Figure 5:
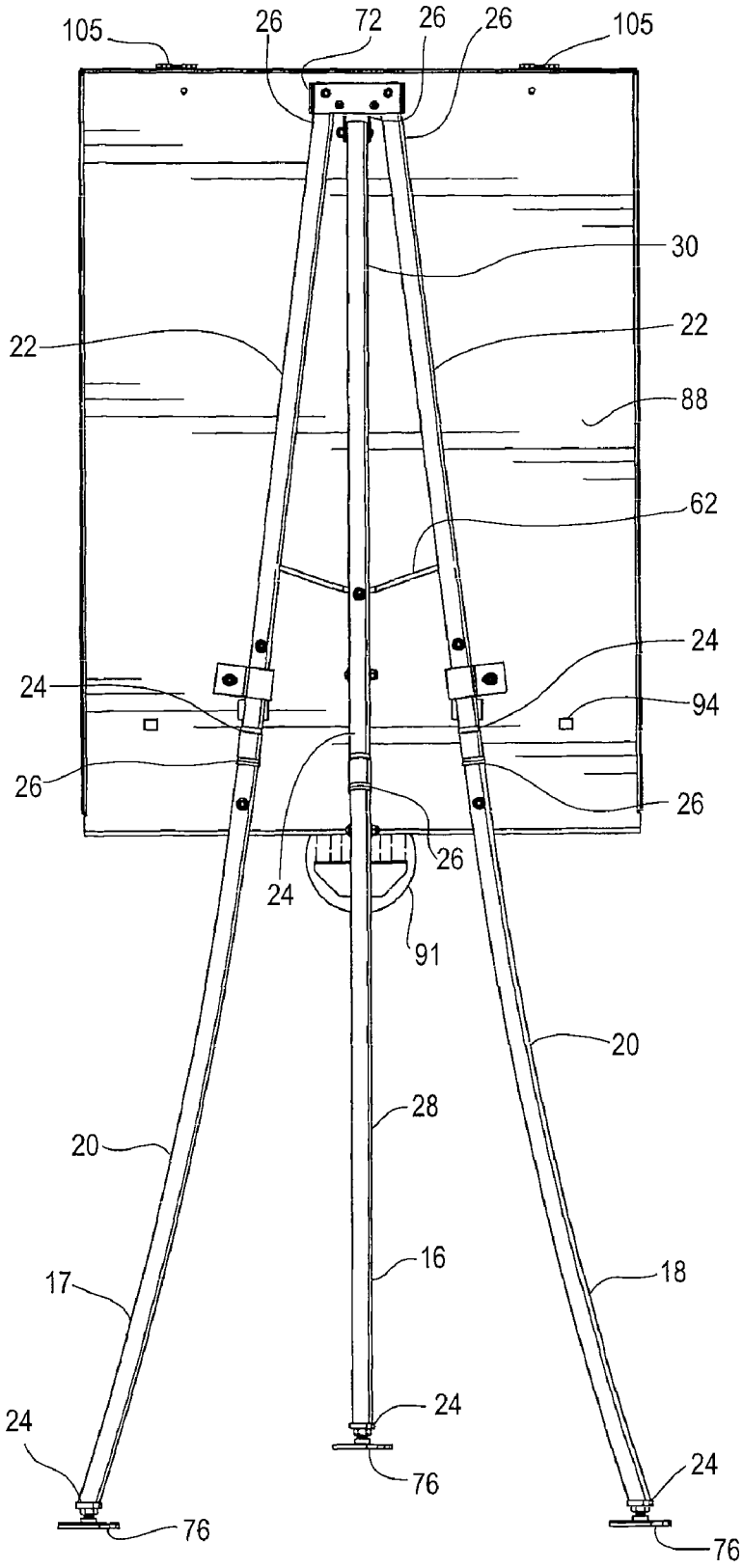
FIG. 5 is a rear perspective view of the embodiment of the collapsible easel shown in FIG. 1.
Figure 7:
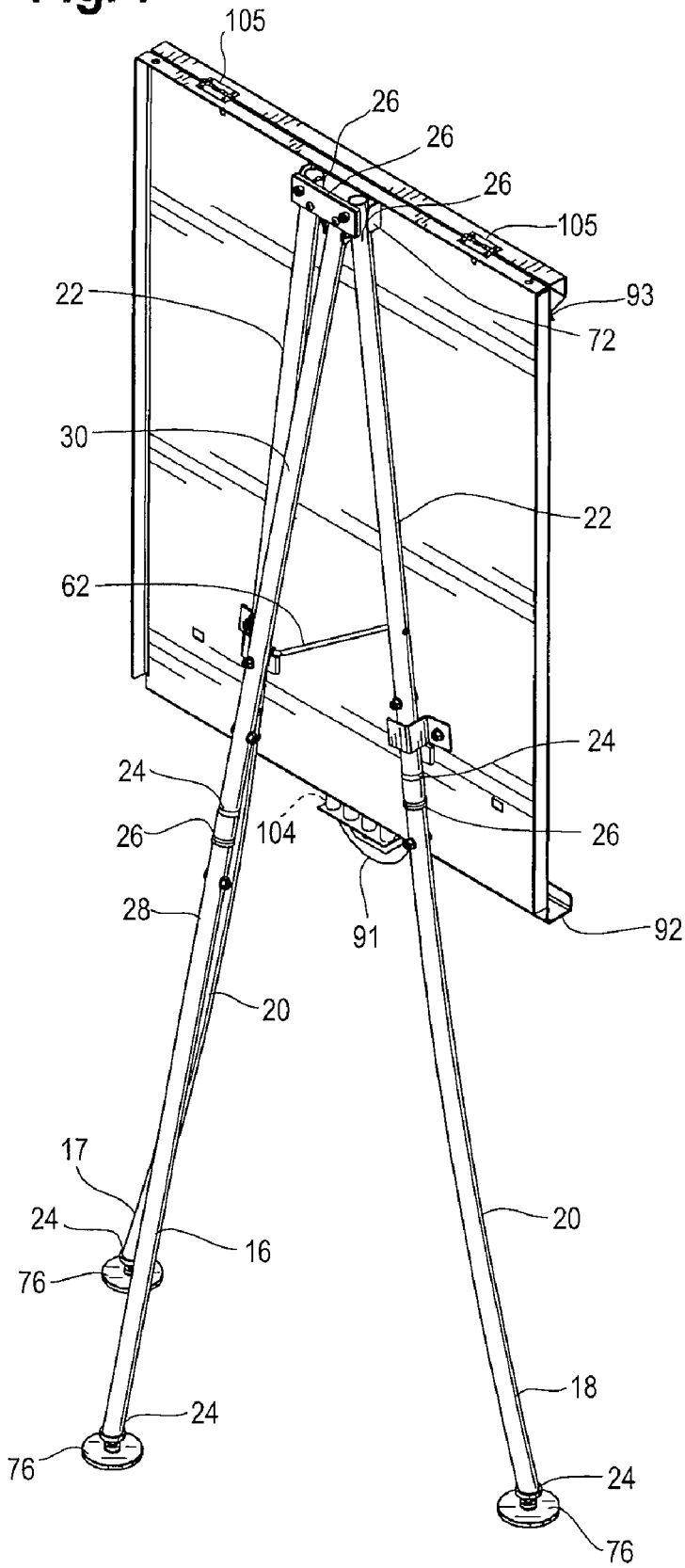
FIG. 7 is a rear perspective view of the embodiment of the collapsible easel shown in FIG. 1.
Figure 8:
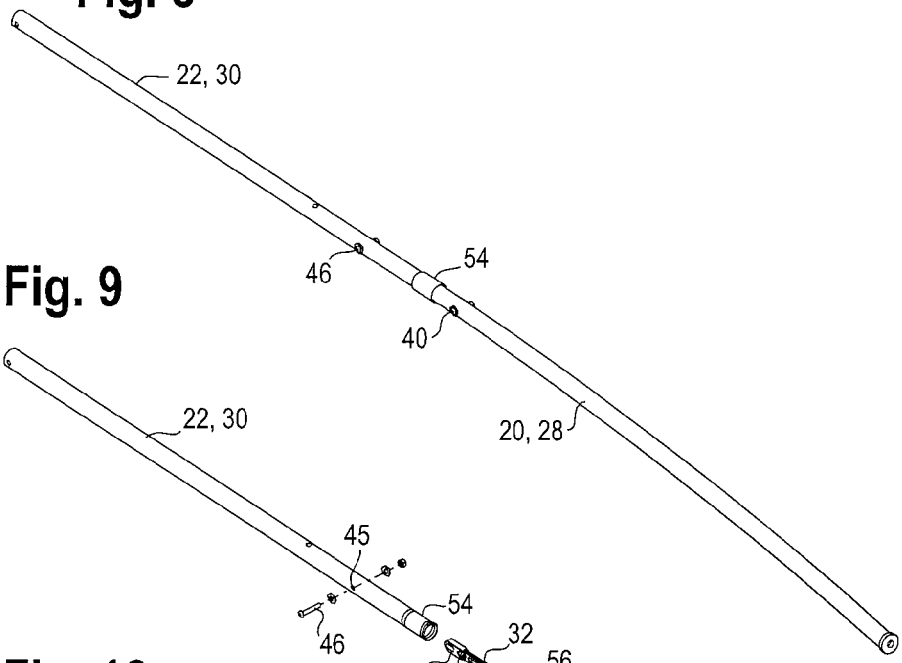
FIG. 8 is a perspective view of one leg of the leg assembly of the present invention shown in FIG. 1, showing the two portions of the leg assembly in their joined or connected configuration.

In the illustrated embodiment best shown in FIGS. 1 and 3-5, the leg assembly 14 includes a rear leg 16 and two front legs 17 and 18. Each front leg 17, 18 has at least two portions, a first curved lower portion 20 (FIG. 5) and a second upper straight portion 22. Each portion 20, 22 of each front leg also has two ends, a first lower end 24 and a second upper end 26 opposite the first end. The rear leg 16 has a longer length relative to the other two front legs 17, 18 for improved support of the easel on a flat surface. The rear leg 16 also has at least two portions, a first lower portion 28 and second upper portion 30 (FIG. 5 and FIG. 7). Both portions 28 and 30 of rear leg 16 are straight in the illustrated embodiment. As shown in FIG. 5, the curved portion 20 of the front legs 17, 18 forms the lower extension of the legs.

Figure 9:
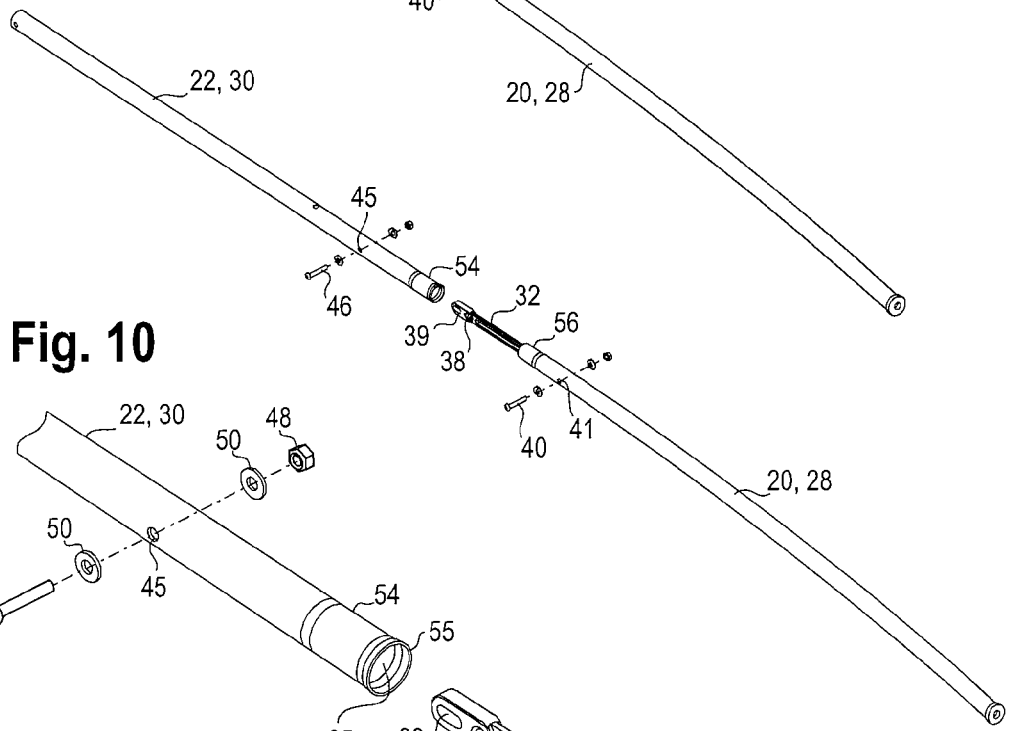
FIG. 9 is an exploded view of the leg of the present invention shown in FIG. 8, showing the leg assembly in its disconnected position.
Figure 10:
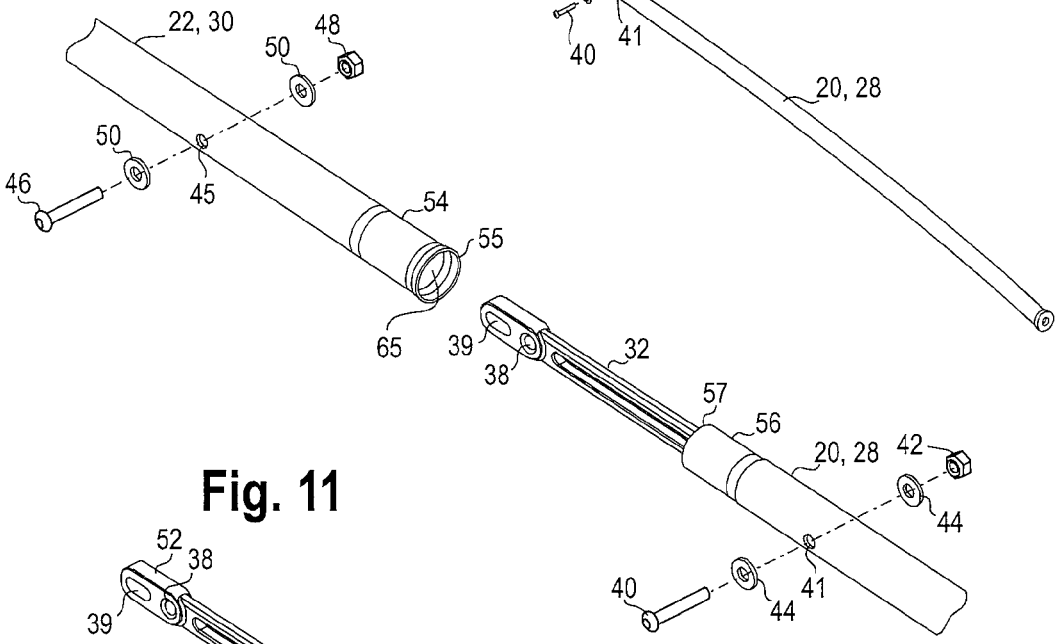
FIG. 10 is a detail view of the assembly of the legs of FIGS. 8 and 9, with a flexible strap for the upper and lower portions of the leg of the present invention shown in FIG. 9.
Figure 11:
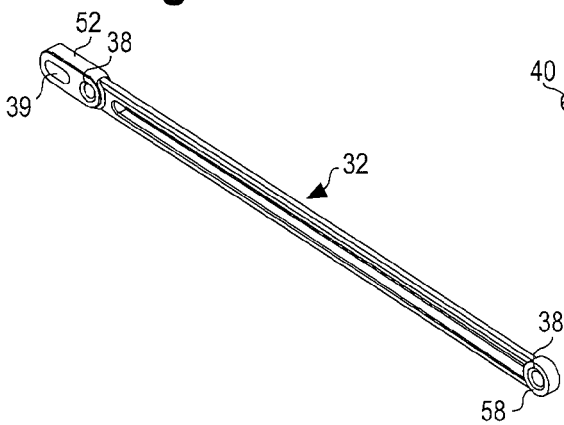
FIG. 11 is a front perspective detail view of one embodiment of the flexible strap joining the two portions of each leg in an embodiment of the present invention.

Referring to FIGS. 8-11, the curved portion 20 and straight portion 22 of each front leg 17, 18, and the straight portions 28,30 of the rear leg 16 are removably connected via a stretchable flexible strap 32 (FIG. 11). Each upper and lower leg portion has a hollow channel and each flexible strap extends between the hollow channel in an upper leg portion and the hollow channel in a corresponding lower leg portion. Strap 32, having first end 58 and second end 52, is connected to an interior wall of the upper leg portion 22, 30 and extends outward from the upper portion 22, 30 of each leg, and is further connected to the lower portion 20, 28 of each leg via an aperture 38 formed on both ends of the strap 32. Each lower leg portion 20, 28 includes an upper indented portion 56 (FIG. 10), and each upper leg portion 22, 30 includes a lower hollow end 54. Lower hollow end 54 of each upper leg portion 22, 30 is configured and dimensioned to allow indented portion 56 of each lower leg portion 20, 28 to be snugly, but slidably inserted into a corresponding lower hollow end 54. Indented portion 56 can be inserted into hollow end 54 a short distance before the outer lip 55 of hollow end 54 abuts the non-indented circumference of lower leg portions 20, 28. When so inserted, as will be explained in further detail, flexible strap 32 applies a compressive force to firmly hold upper leg portions 22, 30 and lower leg portions 20, 28 together, providing the necessary strength for legs 16, 17, 18 to support display panel 12. In an embodiment, one of each upper and lower leg portions further includes a receptacle 65 at an end thereof. The receptacle removably receives an end of the other upper or lower leg portion and removably holds the other leg portion in engagement with the one upper or lower leg portion under the compressive force applied by the flexible strap.

Figure 17:
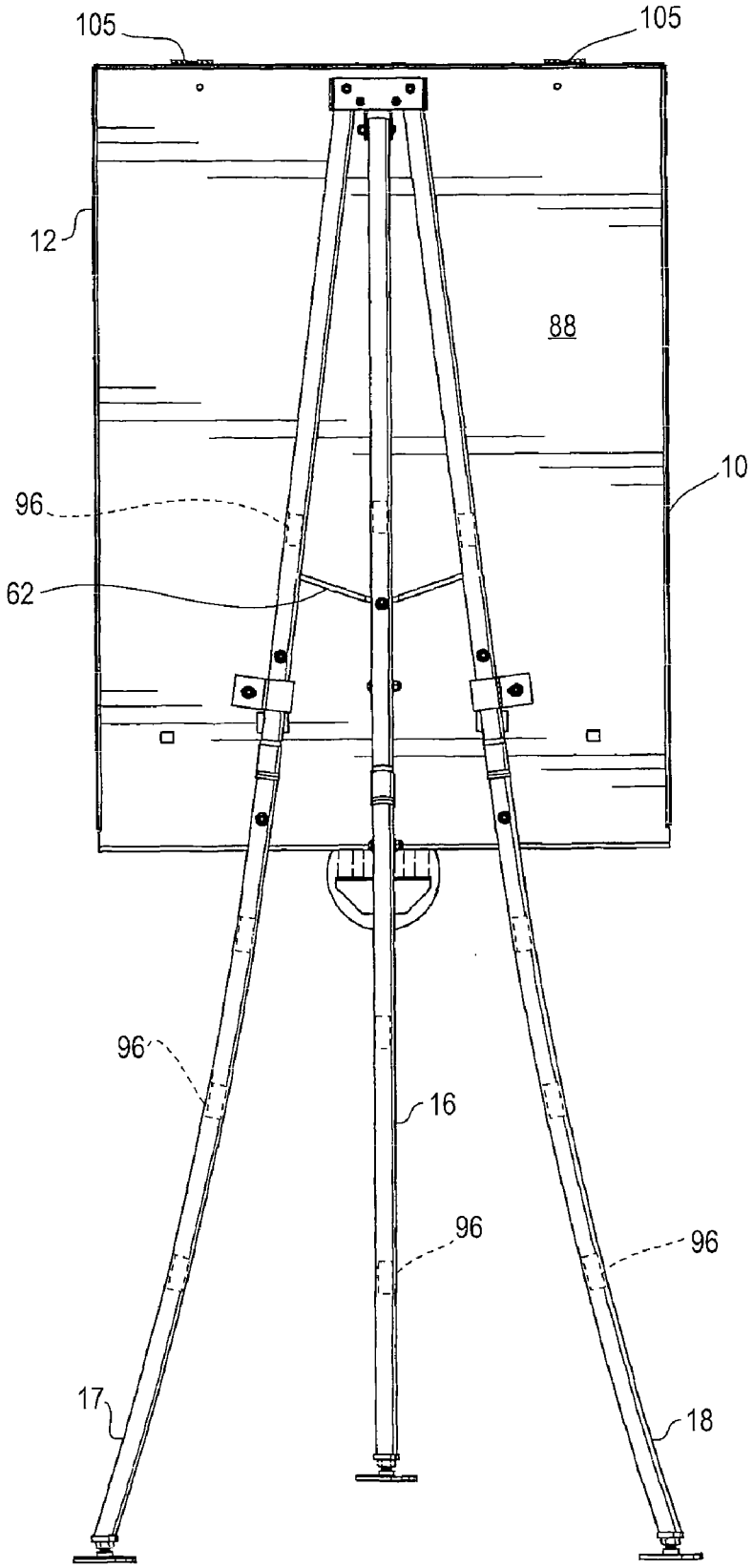
FIG. 17 is a rear perspective view of an alternate embodiment of the easel showing material located throughout the legs to reduce noise and vibration.

To assemble upper portions 22, 30 to lower portions 20, 28 of each leg 16, 17, 18, and referring to FIG. 10, flexible strap 32 is first inserted into the hollow indented end 56 of lower leg portion 20, 28. Tool 51 (FIG. 11C), having a handle 53, an elongated portion 49 and a two-pronged forked end 59 is used to urge flexible strap 32 into lower leg portion 20, 28 from the open bottom end. Forked end 59 engages the lower end of flexible strap 32, and the user applies a linear force to handle 53 advancing strap 32 into the hollow lower leg portion 20, 28 until the lower aperture 38 aligns with apertures 41. Tool 51 is also used to insert noise and vibration dampening material 96 into lower leg portions 20, 28, and into upper leg portions 22, 30, as shown in FIG. 17. Bolt 40 is inserted through aligned apertures 41 on both sides of lower leg portion 20, 28, such that bolt 40 also passes through opposing flat washers 44 and the aperture 38 that is aligned with apertures 41. Nut 42 is attached to bolt 40, and flexible strap 32 is thus secured to lower leg portion 20, 28, with approximately half of the length of strap 32 extending out of hollow indented end 56 past the upper end or lip 57 of indented end 56, as seen in FIGS. 9 and 10. Flat washer 44, 50 serves to protect the surface finish of legs 20, 28 and 22, 30 adjacent to aperture 41 and 45 from damage by spinning bolt 40, 46 and nut 42, 48 during assembly. This flat washer 44 can be made from a high density polyethylene or similar synthetic nylon material without limitation.

Next, the portion of strap 32 extending beyond upper end 57 of indented end 56 is inserted into the hollow portion of upper leg portions 22, 30 through lip 55 and adjacent end portion 54 (FIGS. 9, 10). Next, an elongated hooked tool 61 (FIG. 11D) is extended into upper leg portion 22, 30, and the hooked end 67 of the tool 61 is inserted through aperture 39 (FIG. 11) located in second end 52 of flexible strap 32. A pulling force is applied to the elongated tool, applying a tension force stretching strap 32 until aperture 38 at second end 52 of strap 32 is aligned with apertures 45 (FIG. 10) in upper leg portion 22, 30. Bolt 46 is inserted through apertures 45 and aperture 38, securing strap 32, in tension, to upper leg portions 22, 30. The strap 32 is elastic in the illustrated embodiment, and exerts a force on lower leg portion 20, 28, drawing the upper and lower portions of leg 16, 17, 18 together, drawing end 54 over end 56, with end 56 inserted into end 54 to hold the upper leg portion 22, 30 connected with lower leg portion 20, 28 in a locked position due to the compressive force imparted by elastic, flexible strap 32. Tool 61 is rotated by handle 63 (FIG. 11D) until the hooked end 67 frees itself from aperture 39, and tool 61 is then withdrawn from upper leg portion 22, 30.

Figure 11A:
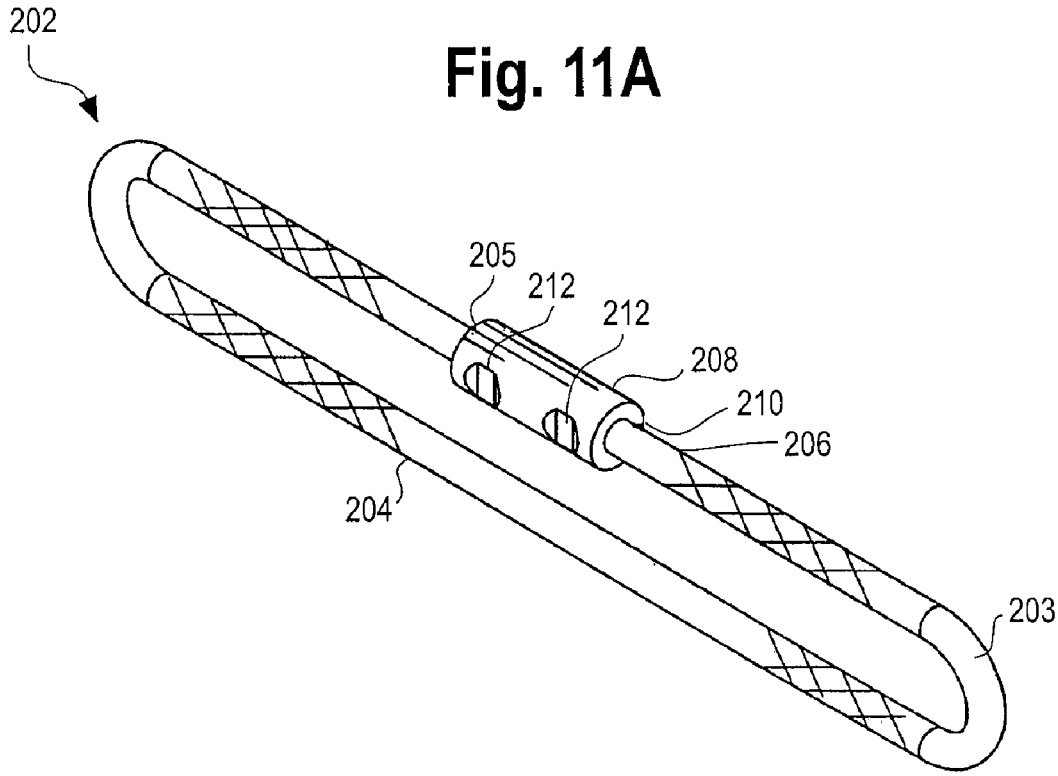
FIG. 11A is a perspective view of a second embodiment of the flexible strap joining each leg portion.

The flexible strap 32 of FIG. 11 is manufactured from elastic, rubber or other similar flexible material. In an alternate embodiment of the flexible strap 32, the strap has a cable elastic structure 202 as shown in FIG. 11A. In this embodiment, the cable elastic 202 is manufactured with a standard rubber elastic core 203 and a cotton outer wrap at 204. The cable elastic 202 includes a first end 205 and a second end 206 which are connected and secured via a splicing device 208 or other similar structure. In FIG. 11A, the splicing device 208 is a tubular butt-splice which is normally manufactured from cold-rolled steel or aluminum. The ends 205 and 206 of the cable elastic 202 are secured in place through an aperture 210 on each side of the splicing device 208. External structures 212, such as fasteners, on the splicing device 208 allow the apertures 210 to receive each end 205 and 206 of the cable elastic 202 and to connect the cable 202 to the fastening device 212. The splicing device 208 holds the cable 202 in place by allowing each end 205 and 206 of the cable 202 to extend through the apertures 210 and to rest inside the splicing device 208.

Figure 11B:
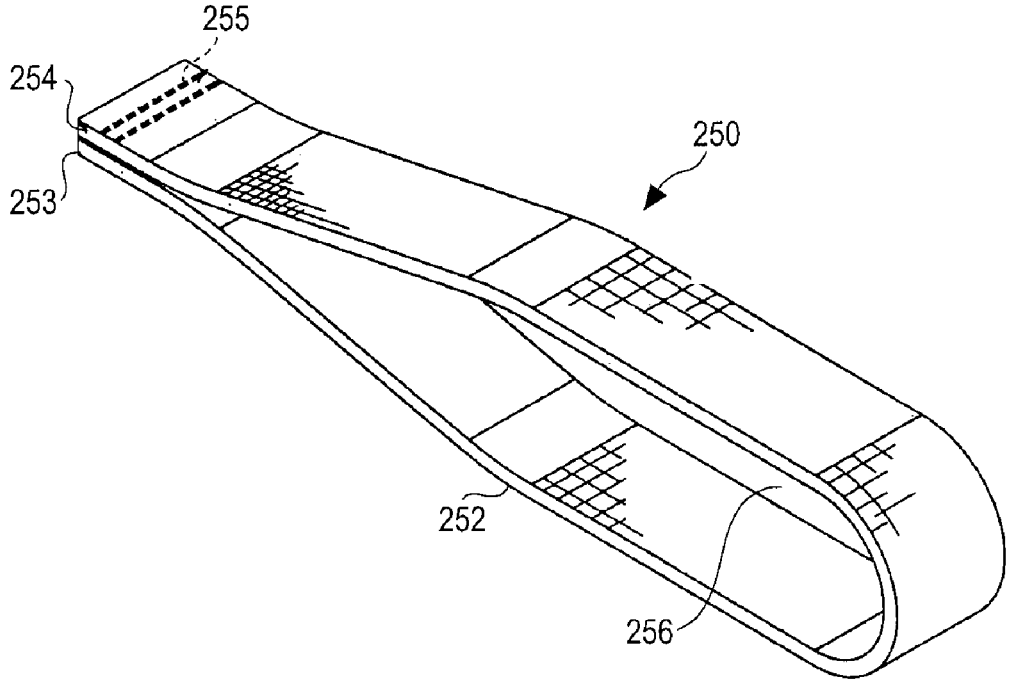
FIG. 11B is a perspective view of a third embodiment of the flexible strap joining each leg portion.
Figure 11C:
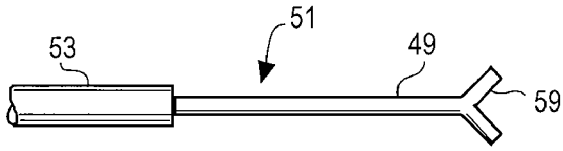
FIG. 11C is a side elevation view of a tool used to assemble the flexible leg structure shown in FIG. 10.

In a further embodiment of the flexible strap 32, the strap comprises a flat elastic structure as shown in FIG. 11B. The flat elastic 250 is manufactured from cotton or another similar man-made elastic material as shown at 252. The flat elastic 250 has a first end 253 and a second end 254 which are folded over and sewn together at 255 in FIG. 11B. The ends 253 and 254 are sewn together to make a single loop 256 in the illustrated embodiment. In another embodiment, the elastic 250 can be double or triple folded and sewn to provide additional load handling capacity. (Not shown)

Figure 11D:
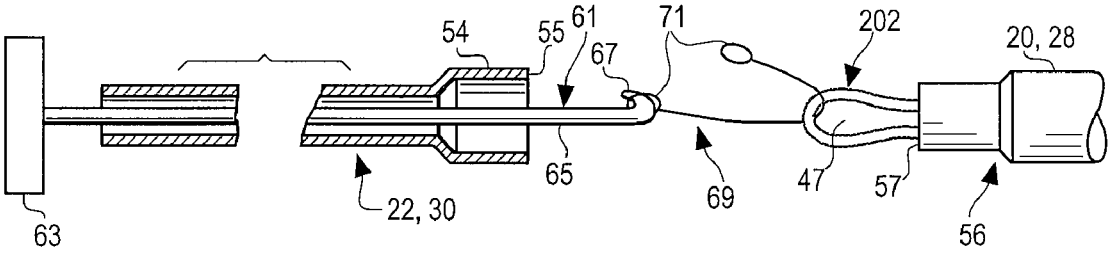
FIG. 11D is a schematic partial sectional view showing the process of assembling the flexible leg structure shown in FIG. 10.

When the elastic strap 32 is substituted with the cotton-wound elastic strap 202 shown in FIG. 11A, assembly of the elastic strap to the lower leg portions 20, 28 and to the upper leg portions 22, 30 is illustrated in FIG. 11D, wherein elastic strap 202 is first inserted into the bottom of lower leg portion 20, 28 using forked-end tool 51 (FIG. 11C) until the upper portion of elastic band 202 extends outward beyond lip 57 of indented portion 56, as seen in FIG. 11D. A bolt 40 (FIG. 10) is inserted through aligned apertures 41 on both sides of lower leg portion 20, 28 such that bolt 40 passes through the loop formed at the end of strap 202 opposite apertures 41. A nut 42 is attached to bolt 40, and flexible strap 202 is secured to lower leg portion 20, 28 with approximately half of the length of strap 202 extending out of hollow indented end 56 past lip 57. Hooked end tool 61 is then inserted into upper leg portion 22, 30 (FIG. 11D) until hooked end 67 extends beyond lip 55 of portion 54 of upper leg portion 22, 30. A string 69, which may be Teflon coated or made of other suitable material and having looped ends 71, is threaded through the opening 47 formed at the end of elastic strap 202 extending beyond upper end or lip 57 of indented portion 56. Both looped ends 71 of string 69 are placed over hooked end 67 of tool 61, and a linear force is applied to handle 63, pulling elastic strap 202 into upper leg portions 22, 30. When opening 47 becomes aligned with apertures 45, bolt 46 is inserted through apertures 45 and opening 47, anchoring elastic strap 202 to the upper leg portion 22, 30. The length of string 69 is such that as opening 47 aligns with apertures 45, hooked end 67 of tool 61 is beyond the open top of upper leg portions 22, 30. Looped ends 71 of string 69 are then removed from hooked end 67, and the string 69 is drawn at one end, thus removing string 69 from opening 47, and from upper leg portion 22, 30. The upper leg portions 22, 30 are then securely but stretchably connected to a corresponding lower leg portion 20, 28.

FIG. 11B shows an alternate embodiment of an elastic band, designated 250. The description above for the assembly of cotton-covered elastic strap 202 shown in FIG. 11A is equally applicable to the assembly of elastic strap 250 to stretchably hold lower leg portions 20, 28 to upper leg portions 22, 30, as mentioned above.

Figure 5A:
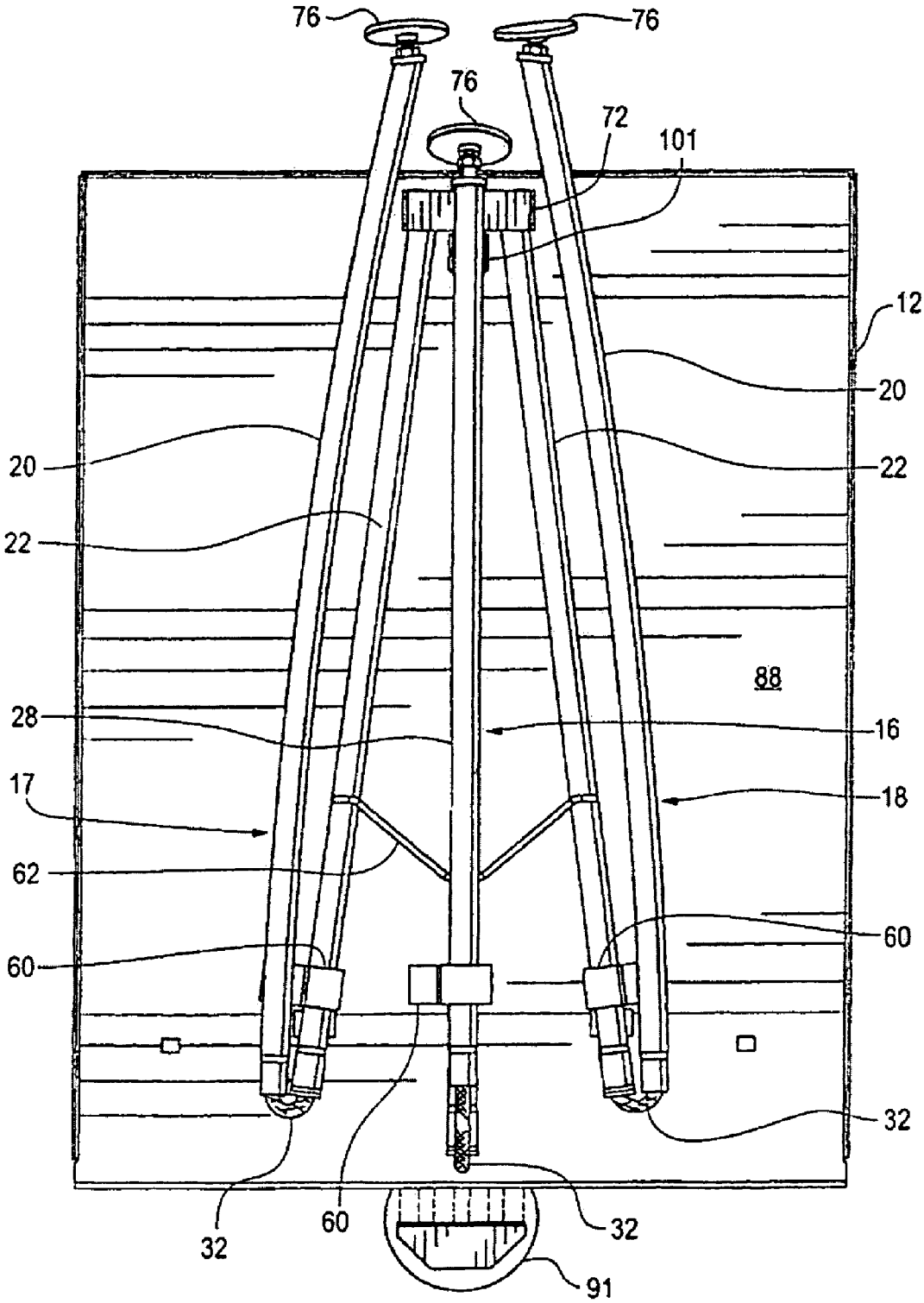
FIG. 5A is a rear elevation view of the collapsible easel of FIG. 1, with the legs shown in their folded position.
Figure 6:
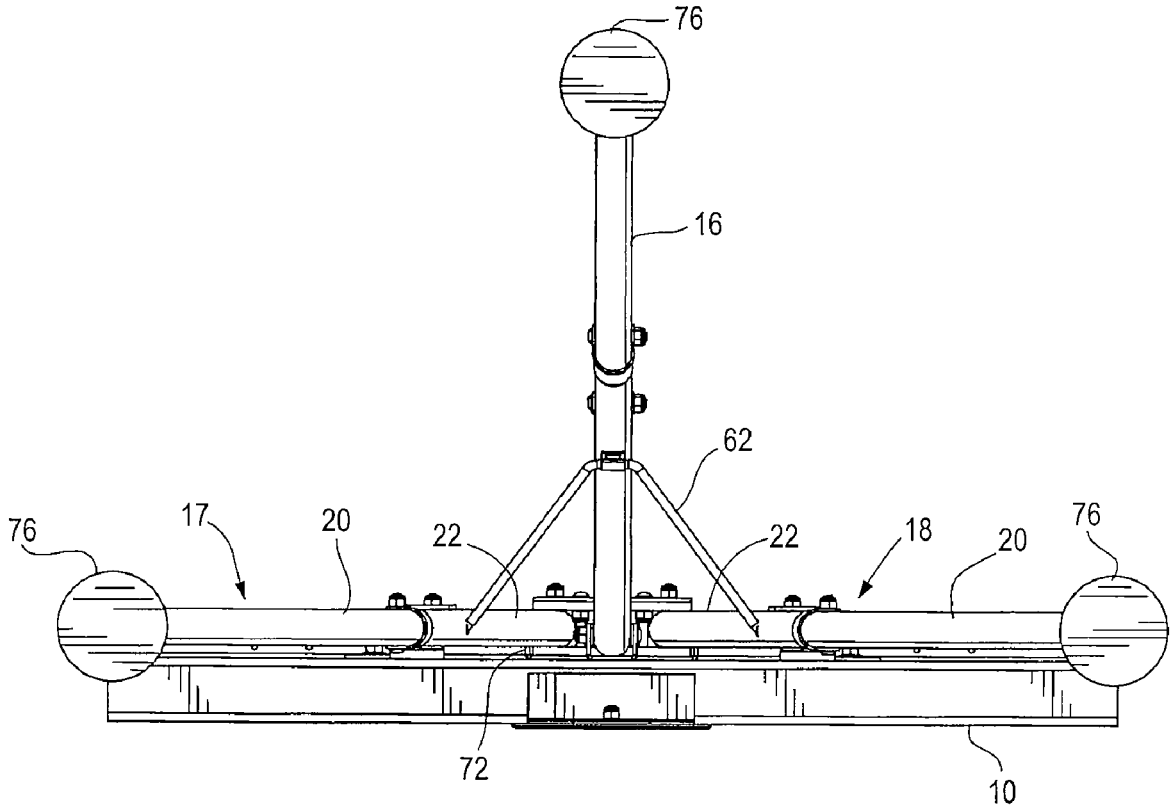
FIG. 6 is a bottom plan view of the embodiment of the collapsible easel shown in FIG. 1.
Figure 15:
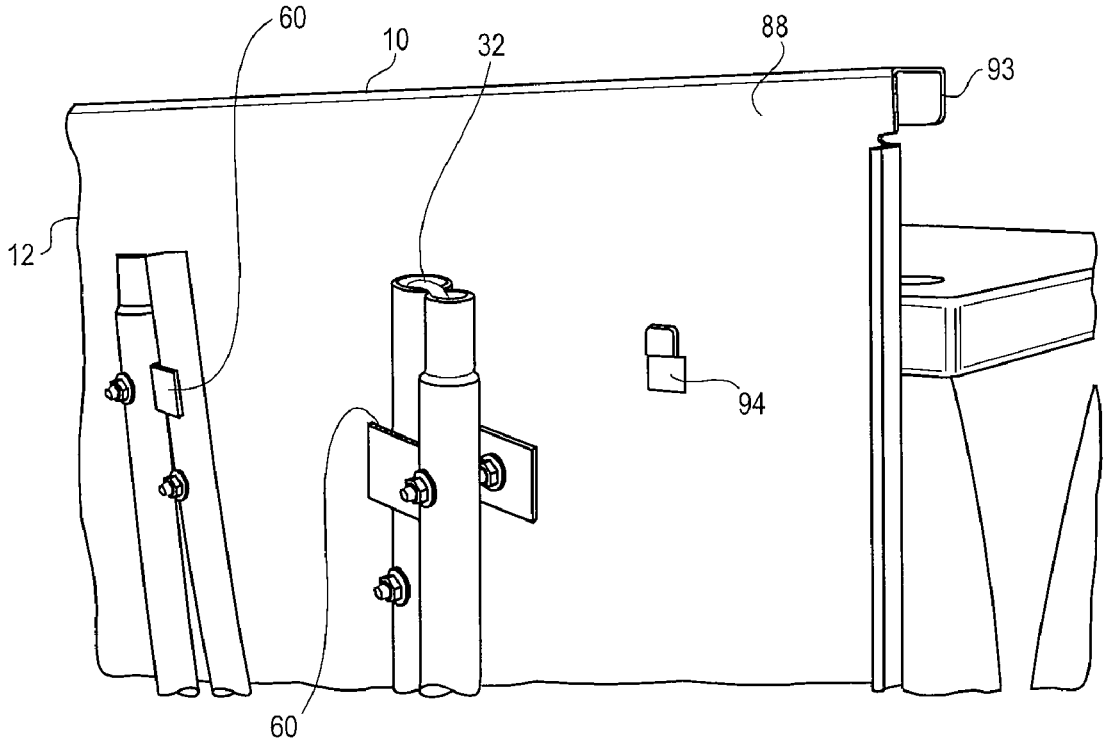
FIG. 15 is a close-up view of a portion of the rear side of the easel shown in FIG. 1, with the easel removably attached to a cart and with the legs of the easel in the folded position.
Figure 16:
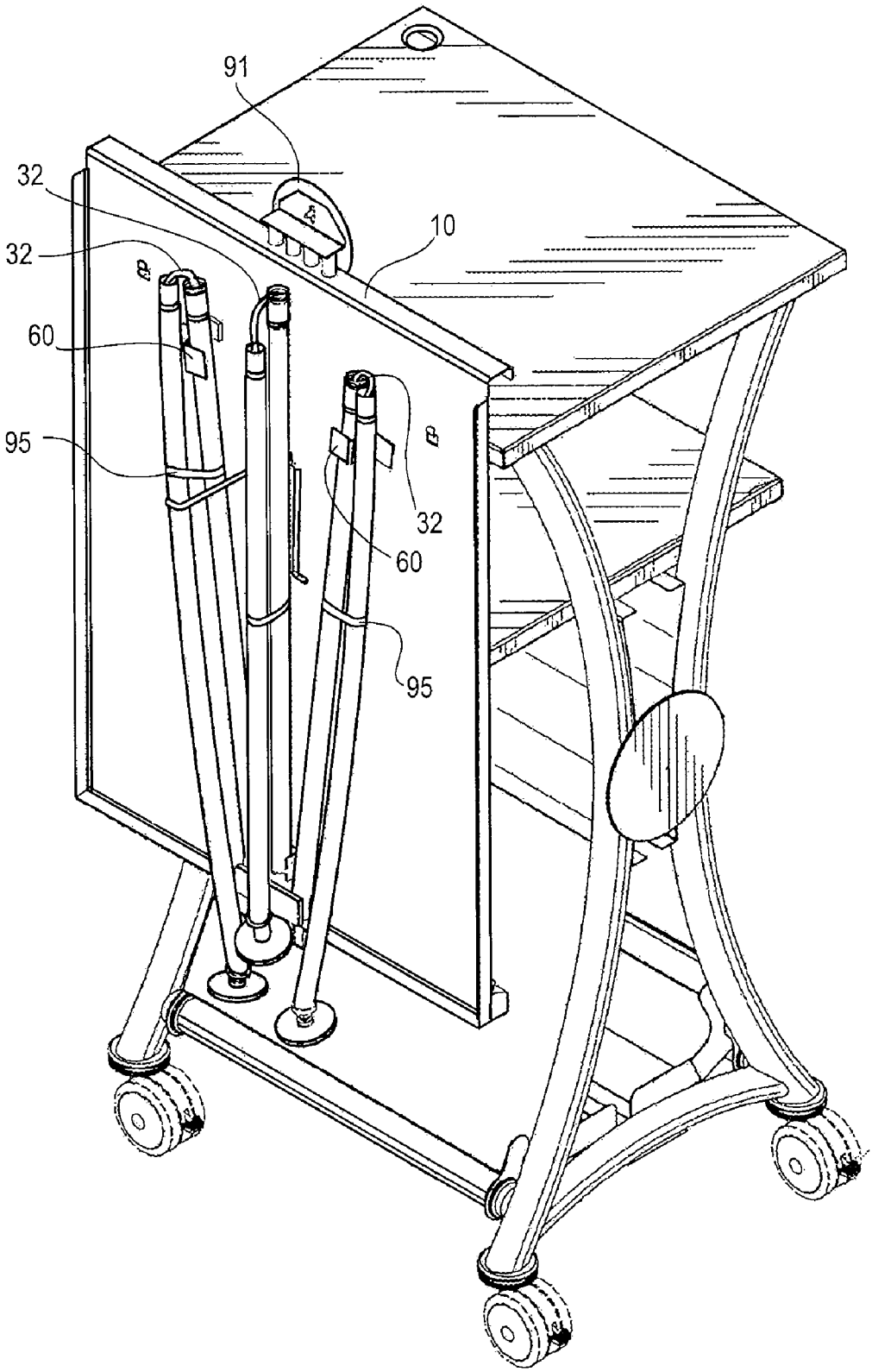
FIG. 16 is a perspective view of the rear of the easel shown in FIG. 1 attached to a cart, with the legs of the easel in the folded position.

As best seen in FIGS. 5A and 15-16, the strap 32 allows a user to fold each leg one hundred eighty degrees for easier transportation and storage of the easel when not in use. To fold the legs 16, 17, 18, the first leg portion 20, 28 and the second leg portion 22, 30 of each leg 16, 17, 18 are manually pulled in opposite directions, extending the flexible strap 32 beyond its tension position that holds the leg portions together in the position shown in FIG. 8. When the flexible strap 32 is extended, indented end 56 of leg portion 20, 28 withdraws from end portion 54 of leg portion 22, 30. The two portions of the legs are then folded towards each other about the flexible strap 32, as seen in FIG. 5A, to reduce the overall length of each leg and provide for easier transport and storage of the easel. The flexibility of strap 32 allows the strap to be bent through one hundred eighty degrees. As shown in FIGS. 5A and 15-16, a suitable clasp 60 located on the rear of display panel 12 holds each folded leg 16, 18 in place along the rear of the display panel 12 for storage or transportation of the easel. If desired, cloth straps 95 (FIG. 16) can be wrapped around the upper and lower leg portions in their folded positions to prevent strap 32 from moving the leg portions away from their folded position. Straps 95 can be fitted with plastic hook and loop fastening elements, as is known in the art.

Figure 12:
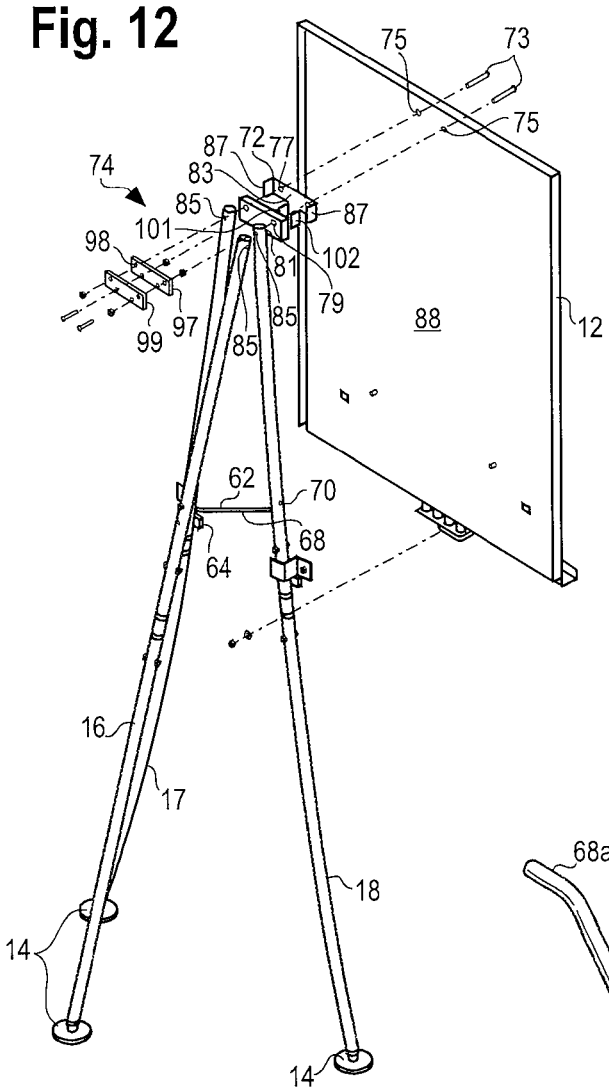
FIG. 12 is an exploded perspective view of the assembly of the easel of the present invention.
Figure 13:
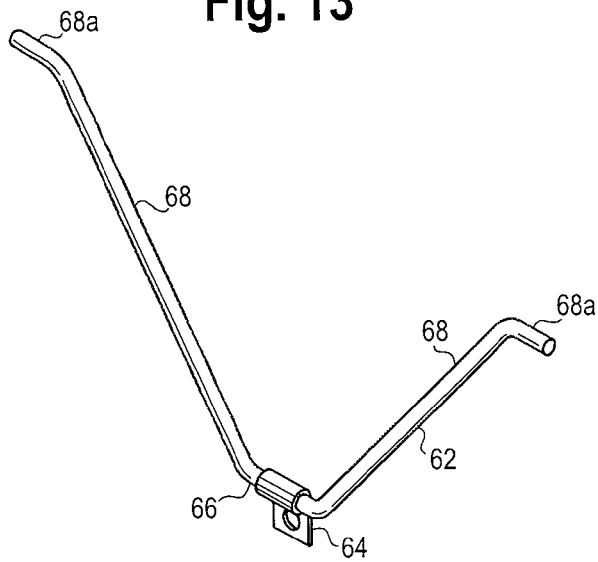
FIG. 13 is a front perspective view of the V-spring locking mechanism for the easel shown in FIGS. 1&3.
Figure 14:
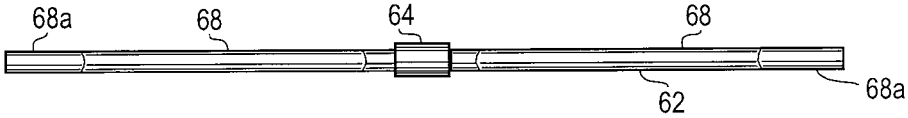
FIG. 14 is a top view of the V-spring locking mechanism shown in FIG. 13.

When the leg assembly 14 is fully extended, the legs are held in place by a spring locking assembly 62. In the illustrated embodiment shown in FIGS. 1-17, and in particular FIGS. 12-14, the spring locking assembly 62 has a V-shape configuration and pivotally connects to the rear leg 16 via a bracket 64. The locking assembly 62 includes a horizontal bar 66 with two extensions 68 connected to the horizontal bar 66 and extending away from the horizontal bar 66 at a forty-five degree angle to the plane of the bar 66 as shown in FIG. 13. The spring locking assembly 62 is pivotally mounted to the rear leg 16 of the leg assembly 14 via bracket 64 located on the horizontal bar 66. The V-shaped spring 62 engages the front legs 17, 18 of the leg assembly via a spring latching mechanism when the extensions 68 of the spring locking assembly 62 are pressed inward and released. (FIG. 12). The front legs 17, 18 of the leg assembly 14 removably receive the lateral extensions 68*a* of extensions 68 through apertures 70 located in each of the front legs. (FIG. 12) In an embodiment, the rear leg may have multiple apertures in which the bracket 64 for the V-spring can engage the rear leg so that a user can effectively change the angle at which the easel will recline.

Referring to FIG. 12, a bracket 72 pivotally connects the leg assembly 14 to display panel 12. The leg assembly 14 is further pivotally secured to the display panel 12 and bracket 72 via a plate and spacer assembly 74, the latter providing a pivotal mount for the leg assembly that is held in place by mechanisms well known in the art such as a washer and nut. The location of washers in this design prevents metal-to-metal contact within the leg assembly and provides increased resistance to metal abrasion.

Referring to the top portion of FIG. 12, bracket 72 and plate and spacer assembly 74 are attached to the rear 88 of display panel 12 by a pair of elongated bolts 73 that extend from the front side 86 to the rear side 88 of display panel 12 through a pair of apertures 75. Each bolt 73 also extends through corresponding apertures 77 in bracket 72, with the rear portion of bracket 72 abutting the rear face of display panel 12. Bolts 73 then extend through apertures 79 in cushioning plate 81, the latter abutting face 83 of bracket 72 and in contact with one side of each of legs 17, 18. Cushioning plate 81 is made of a cushioning, low-friction material such as plastic, matted fabric, or other soft material to reduce friction and wear resulting from physical contact caused by pivotal movement of legs 17, 18.

As also seen in FIG. 12, a pair of aligned apertures 85 are disposed near the top of each front leg 17, 18, and each bolt 73 extends through corresponding aligned apertures 85 to mount legs 17, 18 on bolts 73, allowing legs 17, 18 to pivot about bolts 73 through a relatively small arc. For this purpose, bracket 72 includes two end flanges 87 that engage legs 17, 18 after the legs pivot away from each other through a short arc parallel to the plane of rear face 88 of display panel 12 about bolts 73, and hold legs 17, 18 in their outermost pivotal position when the easel 10 is in use. When the easel is stored or transported, the legs 17, 18, after being folded as described above, are pivoted towards each other about bolts 73 until portions of the legs 17, 18 abut each other, limiting further pivotal movement.

A second cushioning plate 97 (FIG. 12) includes apertures 98 through which bolts 73 also extend, with cushioning plate 97 abutting the sides of legs 17, 18 opposite the side in contact with cushioning plate 81. Thus, each leg 17, 18 is pivotally sandwiched between cushioning materials 81 and 97. Cushioning plate 97 is made of the same low friction material comprising cushioning plate 81. As legs 17, 18 pivot about bolts 73 through short arcs, the cushioning plate material 81, 97 prevents the finish coating covering legs 17, 18 from being worn. Back plate 99 abuts one face of cushioning material 97, and holds cushioning material 97 against the opposite side of legs 17, 18 that are in abutment with cushioning plate 81, thus pivotally holding legs 17, 18 between cushioning plates 81 and 97. When legs 17, 18 pivot about bolts 73, no noise is generated because of the juxtaposition of cushion plates 81, 97 against pivoting legs 17, 18. When assembled as described above, a nut 100 is threaded onto one end of each bolt 73 to hold the back plate 99 against cushion plate 97, and cushion plate 81 against face 83 of bracket 72, and holding cushion plates 81, 97 in frictional contact with legs 17, 18.

Bracket 72 also includes a pair of downwardly extending opposed flanges 101, each flange having an opposed aperture 102. A bolt 103 is adapted to extend through apertures 102 and through corresponding apertures (not shown) in the upper portion of rear leg 16. Thus bolt 103 pivotally connects rear leg 16 to bracket 71, and to the rear of front panel display 12, allowing leg 16 to pivot rearwardly about bolt 103 and away from front panel display 12 when easel 10 is set up in a tripod configuration.

At the lower end 24 of each leg 16, 17, 18, a swivel connection or leveler 76 having a flat bottom surface is attached to each leg to ensure that the easel 10 is stable when erected on a flat or level surface and in an upright position for use.

Figure 1:
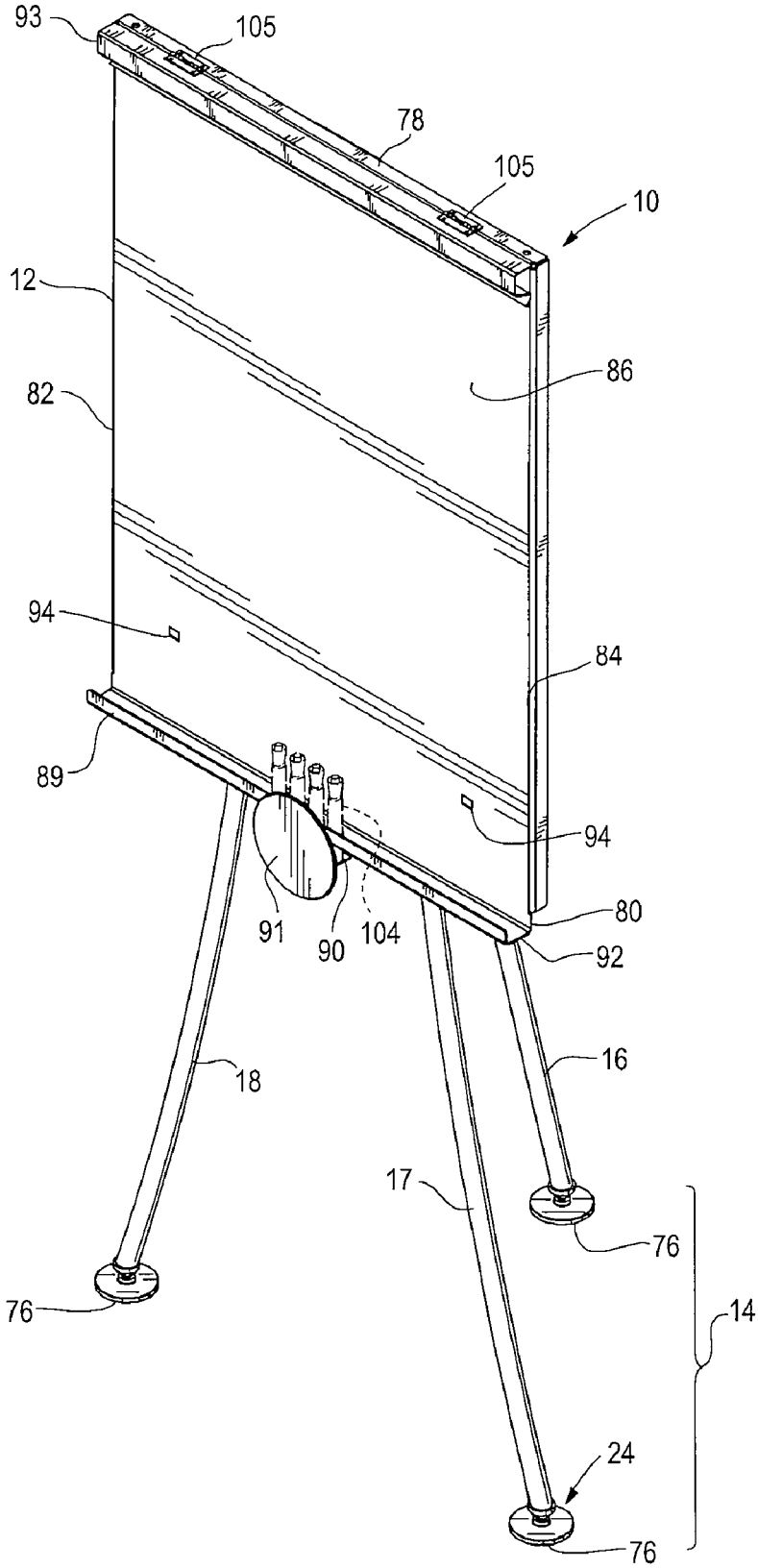
FIG. 1 is a front/side perspective view of an embodiment of the collapsible easel of the present invention.
Figure 2:
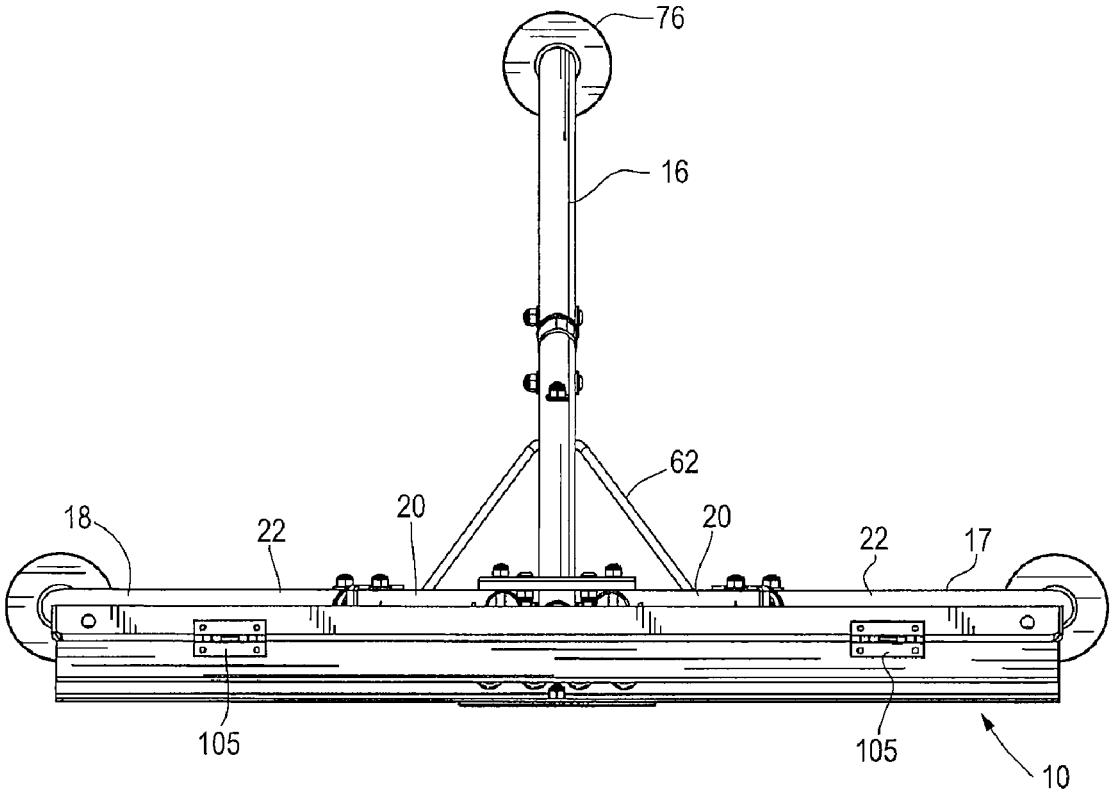
FIG. 2 is a top plan view of the embodiment of the collapsible easel shown in FIG. 1.
Figure 3:
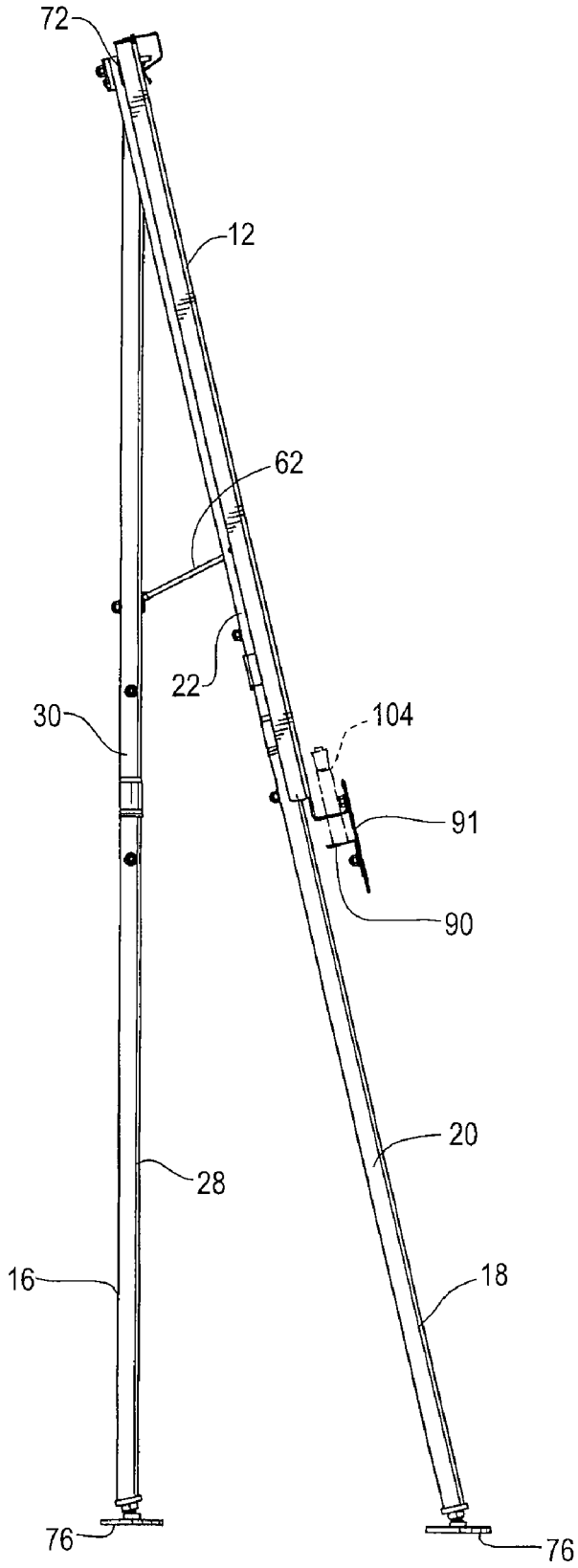
FIG. 3 is a side elevation view of the embodiment of the collapsible easel shown in FIG. 1.

In the embodiment shown in FIG. 1, the front display panel 12 has a generally rectangular shape with a top edge 78, a bottom edge 80, a first side 82, a second side 84, a front side 86 and a rear side 88 (FIG. 5). An extension structure 89 on the bottom edge 80 of the display panel 12 holds a bracket 90 adapted to support a plurality of writing instruments 104, the bracket 90 mounted near a central portion of the extension 89. In FIGS. 1 and 4, the bracket is shown to have a decorative front plate 91 in the shape of a circular disk. The extension structure 89 protrudes outwardly perpendicular from the plane of the display panel 12, and includes a flange extending upwardly parallel to the plane of the display panel to form ledge 92 to which bracket 90 is attached. Ledge 92 also holds other equipment on the display frame, such as a laser pointer, eraser, or the like.

The top edge 78 of the display panel 12 also includes a pivotal clamp 93 for attachment of a flip chart or other visual display to front display panel 12. The clamp 93 can be a spring, clip, or other equivalent structure. In the illustrated embodiment of FIGS. 1-7, the clamp 93 is mounted to panel 12 by a plurality of self-acting spring hinges 105, such as torsion spring hinges or the like, mounted to the top edge 78 of the display panel 12. The clamp 93 is pivoted by a user in an upward direction opposite the plane of the display panel, allowing the creation of space between the clamp and the display panel to insert or place a flip chart or other visual aid near the top edge of the display frame. The self-acting springs 105 return to their resting position adjacent the display frame, now holding the flip chart or other visual aid securely in place between the clamp 93 and the display panel 12.

The display panel 12 further includes at least one aperture 94 (FIG. 1) extending through the panel to provide for removably mounting the easel 10 on another apparatus, if desired, by a user for transport or storage. In the illustrated embodiment shown in FIGS. 1-7, the display panel 12 includes two apertures 94 extending through the front side 86 and rear side 88 of the display panel 12 for removably mounting the easel 10 to an audiovisual cart or other apparatus for transportation or storage.

In another embodiment of the easel 10 shown in FIG. 17, the hollow legs 16, 17, 18 of the easel are adapted to contain a material 96, such as polyurethane foam or the like, to minimize or dampen noise and vibration through the legs of the easel. The material 96 may be heat activated such that the material is installed during manufacture of the easel, and expands when a surface coating is baked on the legs of the easel. The material 96 may be in the form of blocks, such as circular, rectangular, or the like, located in specified locations throughout the legs 16, 17, 18 of the easel 10.

In operation for the embodiments shown in FIGS. 1-17, and referring to FIG. 5A, the user releases the legs 16, 17, 18 from the clasps 60 holding the legs in the folded position, and assembles each leg to its fully extended position by first rotating the upper and lower portions of each leg around flexible strap 32 until the upper and lower portions of each leg are aligned. The curved and straight portions of each leg are advanced toward each other, aided by the compression force applied to each leg portion by flexible strap 32, until each respective leg portion is connected to its counterpart. Each leg in the leg assembly 14 is then rotated about bolts 73, 103 to extend the leg assembly 14 into a tripod position as seen in FIGS. 1 and 7. The user locks the legs 16, 17, 18 into place by securing the spring locking clamp 62 from the rear leg 16 to each of the front legs 17, 18. This is accomplished by pressing the extensions 68 (FIG. 14) toward each other and inserting the extensions 68*a* into apertures 70 in legs 17, 18 to latch the front legs to rear leg 16. After use, the user presses the V-spring 62 inward and removes the extensions 68*a* of the V-spring locking assembly from the apertures 70 in front legs 17, 18 to collapse the tripod formation formed by the leg assembly 14. The curved and straight portions of each leg 16, 17, 18 are pulled apart against the compression force of flexible strap 32 as previously described. The upper and lower portions of each leg are then folded over each other and inserted under respective clasp 60 to reduce the space needed for storage and facilitating transportation of the easel.

Figure 18:
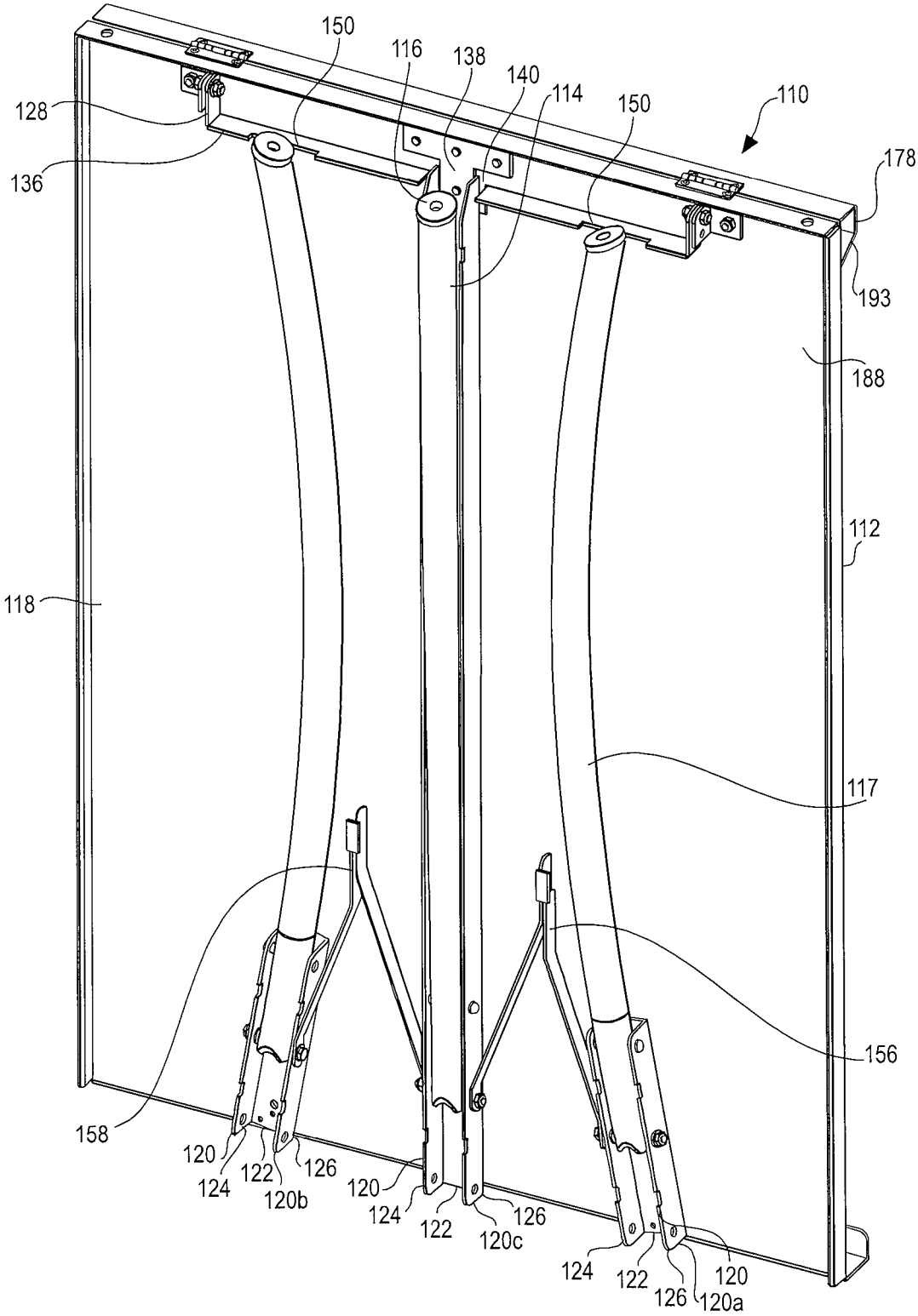
FIG. 18 is a rear perspective view of another alternative embodiment of the easel with the legs shown in the folded position.
Figure 19:
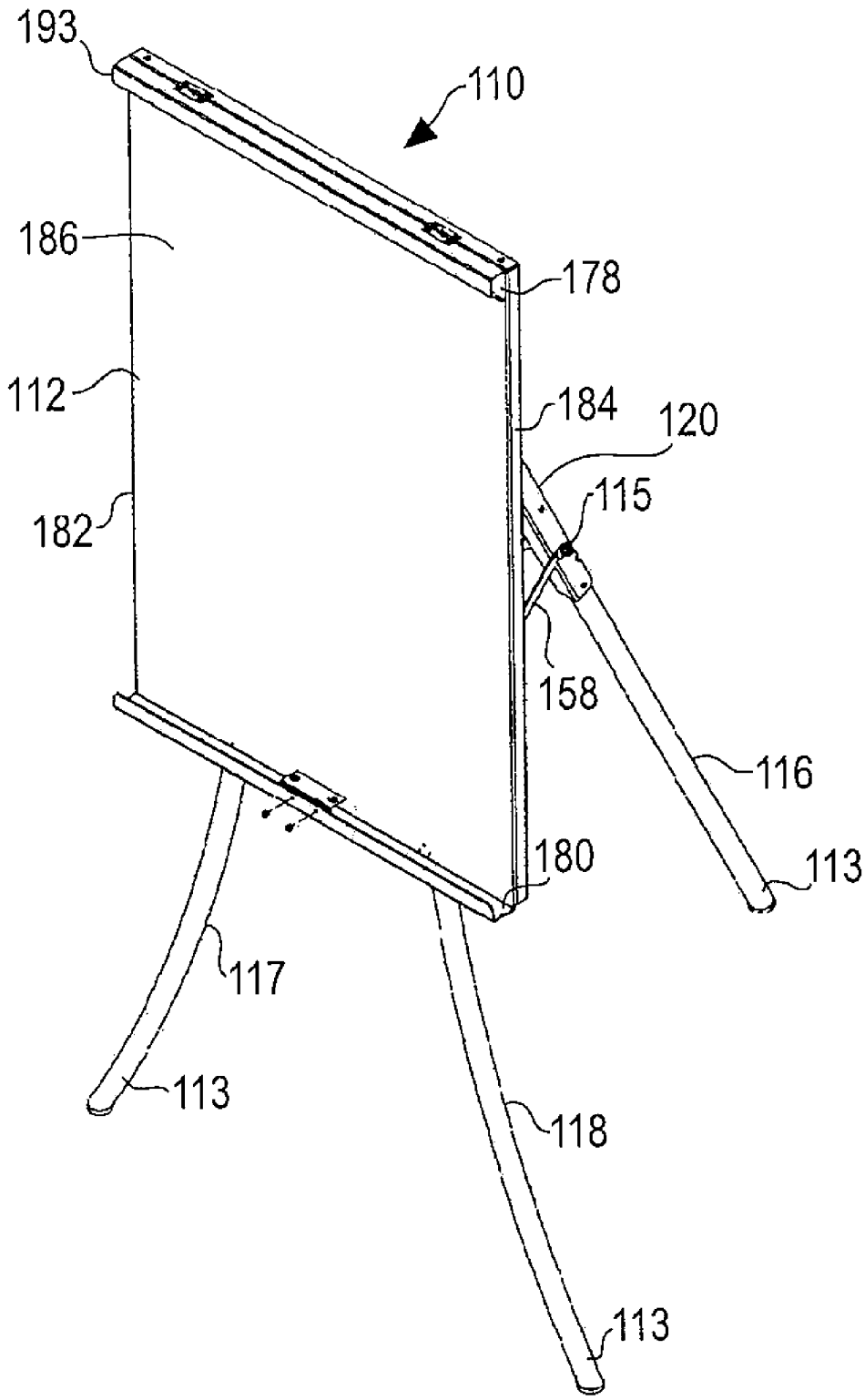
FIG. 19 is a front perspective view of the embodiment of the easel shown in FIG. 18.
Figure 20:
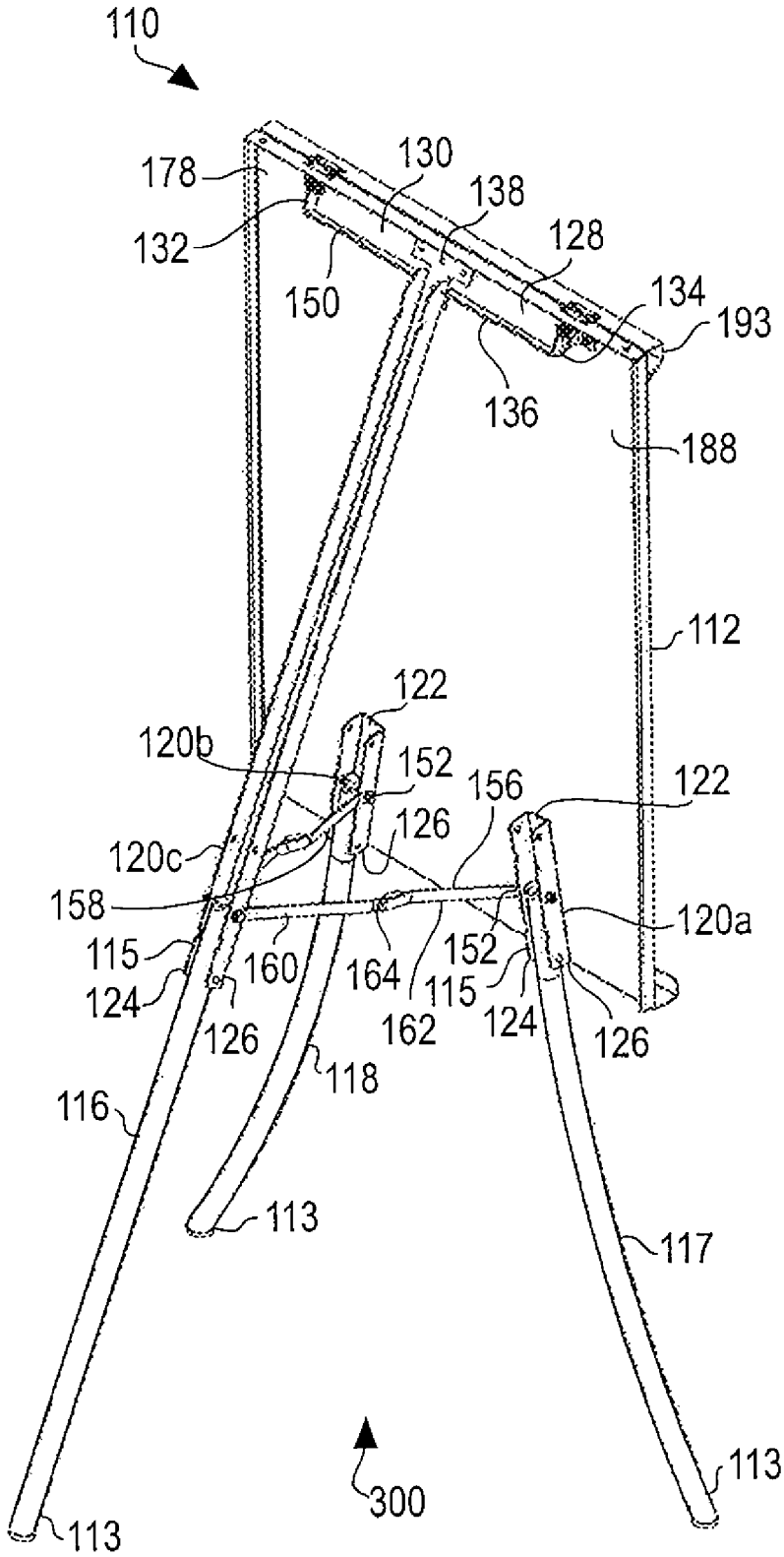
FIG. 20 is a rear perspective view of the embodiment of the easel shown in FIG. 18.
Figure 21:
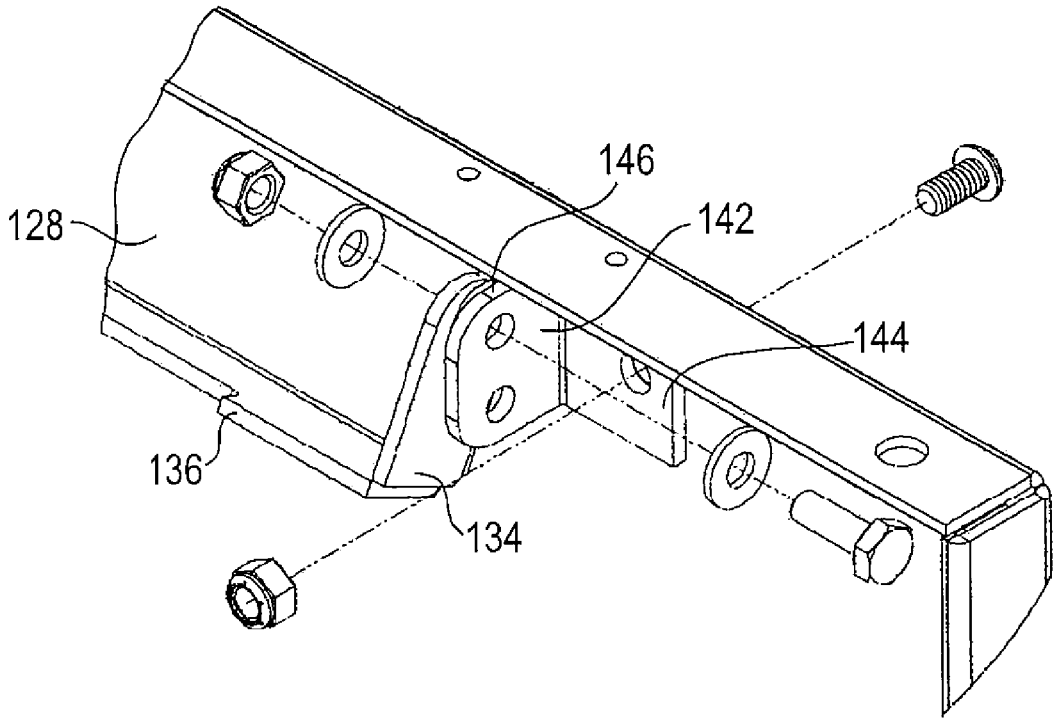
FIG. 21 is a detail view of a portion of the pivoting flange for the leg assembly.

In another illustrated embodiment shown in FIGS. 18-22, the easel 110 comprises a display panel member 112 and a leg assembly 114 which includes a rear leg 116 and two front legs 117 and 118. Each leg has a lower end 113 and an upper end 115. A substantially U-shaped channel 120 is connected to at least a portion of each of the three legs 116, 117, and 118 and allows each leg to extend from the channel in an open tripod position. The channel 120 has a back side 122, a first side 124, and a second side 126. Each channel 120 connects to an upper end 115 of each leg by fastener mechanisms known in the art such as bolts, screws, washers, nuts, and the like. When the easel is in the first open tripod position, the back side 122, first side 124, and second side 126 of each channel 120 provide sturdy support for each of the legs, as shown in FIG. 20, to extend from the channel 120 and be supported on a substantially horizontal surface such as a floor, stage, platform, or the like. When the easel 110 is in the second folded or collapsed position, each channel 120 provides a location for the respective leg to be supported by the first 124 and second side 126 against the back side 122 of the channel 120 and to be in nested contact with the rear side 188 of the display panel at 150 to facilitate easy transportation and storage of the easel 110. The channels 120*a* and 120*b* for each of the front legs 117, 118 are securely and immovably connected to the rear side 188 of the display panel 112 as shown in FIG. 20.

In the illustrated embodiment, the channel 120*c* for the rear leg 116 is connected to a pivoting flange 128 on the rear side 188 near the top edge 178 of the display panel member 112. The pivoting flange 128 allows the channel 120*c*, while in contact with the rear leg, to pivot away from the rear side of the display panel and provide a location for the rear leg 116 to rest on a substantially horizontal surface at an approximate angle with respect to the display panel 112 to provide a sturdy support for the easel in the open tripod position. In the illustrated embodiment, the channel 120*c* for the rear leg is pivoted away from the display panel at an angle of approximately forty-five degrees. One of ordinary skill in the art will appreciate that this angle can vary depending on the angle at which a user or manufacturer seeks to incline the display panel 112 for displaying objects. In a second closed position, the flange 128 allows each leg to nest on the flange 128 at a location designated 150. The rear leg 116 will collapse against back side 122 of channel 120*c* with the lower end 113 of the rear leg 116 resting against pivoting flange 128 at 150. Similarly, each front leg 117, 118 will fold up along channels 120*a*, 120*b* and the lower end 113 of each front leg 117, 118 will rest against pivoting flange 128 at selectively spaced indentions 150.

Figure 22:
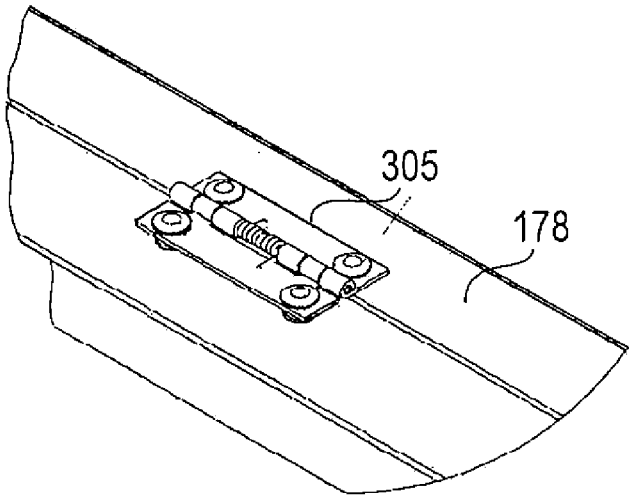
FIG. 22 is a detail view of the hinge located on the top side of the display panel.

The pivoting flange 128, as shown in FIGS. 20 and 22, includes a back side 130, a first side 132, a second side 134, and a bottom edge 136. The channel 120*c* for the rear leg 116 is connected to the back side 130 of the pivoting flange 128 at 138 through an aperture 140 in the bottom edge 136. The channel 120*c* is connected to the pivoting flange 128 via mechanisms well known in the art such as bolts, screws, and the like. As shown in FIG. 22, an L-shaped bracket 142 adjacent first side 132 and second side 134 of the pivoting flange 128 secures the flange 128 to the rear side 188 of the display panel member 112. The bracket 142 is secured to the rear side 188 of the display panel 112 at 144 and to the first side 132 and second side 134 of flange 128 at 146.

As shown in FIGS. 19-20, when the legs are fully extended in the first open tripod position designated 300, the legs are held in place within each channel 120 by a hinge assembly. In the embodiment shown in FIGS. 18-22, a first hinge assembly 156 connects an inside 152 of channel 120*a* for one front leg 117 to the channel 120*c* for the rear leg 116. A second hinge assembly 158 connects an inside 152 of channel 120*b* for the other front leg 118 to the channel 120*c* for the rear leg 116. The first and second hinge assembly are connected to each of the channels at a location where the upper end 115 of each of the legs 116, 117, and 118 are connected to the first 124 and second 126 sides of the channels 120. Each hinge assembly is connected to each channel and to each leg as shown in FIGS. 18-20 by mechanisms known in the art such as bolts, screws, washers, nuts, and the like. The first 156 and second hinge assembly 158 are connected to the channel 120*c* for the rear leg 116 at the first side 124 and second side 126 of the channel 120*c*.

As best seen in FIGS. 18-20, the first hinge assembly 156 and second hinge assembly 158 further include two struts 160, 162 pivotally connected at 164 near a center line of each hinge assembly. The struts allow each hinge assembly to be rotated in a downward direction at the pivoted connection 164 to support the easel securely in the first open tripod position and similarly rotated in an upward direction at pivot 164 to collapse the easel to a second folded position with the legs nested against the rear side 188 of the display panel member 112. (FIG. 18). In the illustrated embodiment, the legs for each channel 120 are rotated about the first and second hinge assembly in approximately a 180-degree arc. In the open position, the legs are pulled out and downward over the hinge assembly 156, 158 until the legs approach a substantially horizontal surface. When the hinge assembly is fully extended, the legs are in the first open tripod position and locked in place with the struts 160, 162 slightly over center as shown in FIG. 20. Strut 160 further includes a formed ledge 160*a* that locks over the top surface 162*a* of strut 162 when hinge assembly 156, 158 are fully extended.

In the embodiment of FIGS. 18-22, the front display panel member 112 has a generally rectangular shape with a top edge 178, a bottom edge 180, a first side 182, a second side 184, a front side 186, and a rear side 188. The structure and function of the display panel for this embodiment is similar to that previously described for the first embodiment in FIGS. 1-17.

In the embodiment of FIGS. 18-22, the top edge 178 of the display panel member 112 also includes a pivotal clamp 193 for attachment of a flip chart or other visual display to front display panel 112. The clamp 193 can be a spring, clip, or other equivalent structure. The clamp 193 is mounted to panel 112 by a plurality of self-acting spring hinges 305 (FIG. 21), such as torsion spring hinges or the like, mounted to the top edge 178 of the display panel 112. The structure and function of the clamp and self-acting spring hinges for mounting materials to the front of the display panel is similar to that previously described for the first embodiment in FIGS. 1-7.

In operation for the embodiment shown in FIGS. 18-22 and referring to FIG. 18, the user rotates the legs 116, 117, and 118 downward from resting place at 150 along pivoting flange 128 and assembles each leg to its fully extended position by first rotating each leg around hinge assembly 156, 158 into a tripod position 300 as shown in FIGS. 19 and 20. The user locks the legs in place by rotating the legs around hinge assembly 156, 158 until the lateral struts 160, 162 of hinge assembly 156, 158 are fully extended to a slightly over center position (FIG. 20). After use, the user presses the lateral struts upward to rotate channel 120*c* to its position shown in FIG. 18. Each leg 116, 117, 118 is rotated upward until each leg is in the position shown in FIG. 18 to collapse the tripod formation 300 formed by legs in the extended position. Each leg is folded over and rested against pivoting flange 128 at 150 again to reduce necessary storage space and to facilitate easy transportation for the easel.

The foregoing description of illustrated embodiments of the invention has been presented for purposes of description, and is not intended to be exhaustive or to limit the invention to the precise forms disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A collapsible easel with foldable legs for supporting a flip chart or other display device comprising:

a display panel;

at least three legs connected to the display panel, the at least three legs including a rear leg and two front legs, each leg adapted to be engaged with the display panel and maintained in a folded position, each leg positioned against the display panel when each leg is in said folded position;

each leg having a portion that pivots about a pivot point when said leg is moved to said folded position;

said pivot point located adjacent a lower end of said display panel.

2. The collapsible easel of claim 1 wherein said display panel includes an extension structure located at a bottom edge of said display panel, said extension structure protruding outward from said display panel.

3. The collapsible easel of claim 1 wherein the display panel includes at least one aperture through a front side and a rear side, the at least one aperture adapted to removably mount the easel to a cart or other presentation aid for transportation and storage.

4. The collapsible easel of claim 1 wherein at least one of the legs has a hollow portion, the hollow portion containing a material reducing noise and vibration through the legs of the easel.

5. A collapsible easel with foldable legs for supporting a flip chart or other display device comprising:

a display panel at least three legs connected to the display panel, the at least three legs including a rear leg and two front legs, each leg adapted to be engaged with the display panel and maintained in a folded position, each leg positioned against the display panel when each leg is in said folded position, wherein the at least three legs further comprise a three-leg assembly pivotally connected to the display panel, each leg having an upper leg portion and a separate lower leg portion, each upper leg portion and each lower leg portion having a first end and a second end;

wherein each leg further comprises a flexible strap extending between and resiliently connecting each upper leg portion with each lower leg portion of each respective leg, the flexible strap being linearly flexible and allowing the upper and lower leg portion of each leg to be pulled in opposite linear directions relative to each other to selectively disconnect each upper leg portion from a respective lower leg portion, and further to allow each upper leg portion to be folded adjacent a respective lower leg portion.

6. The collapsible easel of claim 5 further comprising at least one clasp attached to the display panel to engage each leg with the display panel and maintain each leg in the folded position.

7. The collapsible easel of claim 6 wherein the at least one clasp is associated with a rear side of said display panel, said at least one clasp engaging at least one of said upper and lower leg portions when said leg portions are folded over each other.

8. The collapsible easel of claim 5 wherein each flexible strap has a first end and a second end, each end connected to an interior wall of an upper leg portion and a corresponding lower leg portion of each leg.

9. The collapsible easel of claim 5 wherein each of said upper and lower leg portions includes a hollow channel, each flexible strap extending between the hollow channel in an upper leg portion and the hollow channel in a corresponding lower leg portion.

10. The collapsible easel of claim 5 wherein each flexible strap applies a compression force on corresponding upper and lower leg portions, biasing said upper and lower leg portions into contact with each other.

11. The collapsible easel of claim 5 wherein one of each upper and lower leg portions includes a receptacle at an end thereof, said receptacle removably receiving an end of the other of said upper and lower leg portions, said receptacle removably holding said other leg portion in engagement with said one leg portion under the force applied by said flexible strap.

12. The collapsible easel of claim 11 wherein said other leg portion has an indented end that removably fits securely inside the receptacle to hold the upper and lower leg portions together in an assembled position.

13. A collapsible easel with foldable legs for supporting a flip chart or other display device comprising:

a display panel, at least three legs connected to the display panel, the at least three legs including a rear leg and two front legs, each leg adapted to be engaged with the display panel and maintained in a folded position, the at least three legs further comprising a three-leg assembly pivotally connected to the display panel, each leg having an upper leg portion and a separate lower leg portion, each upper leg portion and each lower leg portion having a first end and a second end, wherein the leg assembly is pivotally connected to the display panel by a cushioned bracket that applies a cushioned friction force to the front legs when said front legs pivot relative to said display panel.

14. A collapsible easel with foldable legs for supporting a flip chart or other display device comprising:

a display panel, at least three legs connected to the display panel, the at least three legs including a rear leg and two front legs, each leg adapted to be engaged with the display panel and maintained in a folded position, the at least three legs further comprising a three-leg assembly pivotally connected to the display panel, each leg having an upper leg portion and a separate lower leg portion, each upper leg portion and each lower leg portion having a first end and a second end, a spring locking assembly having extensions extending from the locking assembly, a horizontal bar mounted to at least one leg in the leg assembly, the extensions engaging the remaining at least one leg to hold the leg assembly in a tripod position.

15. The collapsible easel of claim 14 wherein the spring locking assembly has a generally V-shaped design.

16. The collapsible easel of claim 14 wherein the extensions of the spring locking assembly are oriented at a forty-five degree angle relative to the plane of the spring locking assembly.

17. A collapsible easel with foldable legs for supporting a flip chart or other display device comprising:

a display panel, at least three legs connected to the display panel, the at least three legs including a rear leg and two front legs, each leg adapted to be engaged with the display panel and maintained in a folded position, a channel connected to at least a portion of each of the at least three legs respectively, each channel comprising a back side, a first side, and a second side, each channel adapted to allow the at least three legs to be individually nested in contact with the rear side of the display panel.

18. The collapsible easel of claim 17 wherein the channel for each of the two front legs is securely fastened to the rear side of the display panel.

19. The collapsible easel of claim 17 wherein the channel for the rear leg is connected to a pivoting flange on the rear side of the display panel, the channel for the rear leg pivoting away from the rear side of the display panel at an approximate angle to the display panel and adapted to allow the easel to be supported in an open tripod position.

20. The collapsible easel of claim 19 wherein the pivoting flange is further adapted to allow each leg to nest on the pivoting flange in a second folded position of the easel.

21. The collapsible easel of claim 17 wherein the at least three legs are connected by a first hinge assembly and a second hinge assembly, the first hinge assembly extending between and connecting an inside of the channel for one front leg and the channel for the rear leg, and the second hinge assembly extending between and connecting an inside of the channel for the other front leg and the channel for the rear leg, the first and second hinge assemblies connected to the channel for the rear leg at the first side and second side of the channel.

22. The collapsible easel of claim 21 wherein the first and second hinge assembly each further comprise at least two struts pivotally connected near a center of the hinge assembly, each hinge assembly adapted to be rotated in a downward direction at said pivoting connection to support the easel in a first open tripod position and rotated in an upward direction to collapse the easel to a second folded position with the legs nested against the rear side of the display panel.

23. The collapsible easel of claim 22 wherein each leg rests along the back side of each channel when the collapsible easel is in a second folded position.

* * * * *